US007020966B2

(12) United States Patent
Shiba et al.

(10) Patent No.: US 7,020,966 B2
(45) Date of Patent: Apr. 4, 2006

(54) DRY SHAVER WITH A CRADLE SHAVING HEAD

(75) Inventors: Takeshi Shiba, Hikone (JP); Fumio Taniguchi, Hikone (JP); Ryo Motohashi, Hikone (JP); Masanobu Yamasaki, Hikone (JP)

(73) Assignee: Matsushita Electric Works, Ltd., Osaka (JP)

( * ) Notice: Subject to any disclaimer, the term of this patent is extended or adjusted under 35 U.S.C. 154(b) by 73 days.

(21) Appl. No.: 10/492,028

(22) PCT Filed: Oct. 31, 2002

(86) PCT No.: PCT/JP02/11359

§ 371 (c)(1),
(2), (4) Date: Apr. 8, 2004

(87) PCT Pub. No.: WO03/041918

PCT Pub. Date: May 22, 2003

(65) Prior Publication Data

US 2004/0231160 A1 Nov. 25, 2004

(30) Foreign Application Priority Data

Nov. 15, 2001 (JP) ..... 2001-350747
Jun. 17, 2002 (JP) ..... 2002-176471

(51) Int. Cl.
*B26B 19/04* (2006.01)

(52) U.S. Cl. ..... 30/43.92; 30/346.51

(58) Field of Classification Search ..... 30/34.1, 30/43.6, 43.9, 43.92, 346.51, 43.91, 527
See application file for complete search history.

(56) References Cited

U.S. PATENT DOCUMENTS 4,797,997 A * 1/1989 Packham et al. ..... 30/43.92

(Continued)

FOREIGN PATENT DOCUMENTS

JP 04-269992 A1 9/1992

(Continued)

OTHER PUBLICATIONS

International Search Report for PCT/JP02/11359 mailed on Mar. 13, 2003.

*Primary Examiner*—Hwei-Siu C. Payer
(74) *Attorney, Agent, or Firm*—Rader, Fishman & Grauer PLLC

(57) ABSTRACT

A dry shaver has a cradle head carrying shaving units as well as a motor for driving the shaving units. The cradle head is supported to a hand grip such that it is allowed to tilt about at least one tilt axis parallel to a thickness direction of the hand grip. At least one portion of the motor projects upwardly of the tilt axis, whereby the cradle head is given overall mass center which is located upwardly of the tilt axis with respect to the height axis of the hand grip. Accordingly, the motor of heavy nature can be best utilized to locate the overall mass center of the cradle head above the tilt axis for generating a torque acting to tilt the cradle head from a neutral position about the tilt axis when the hand grip is held upright.

19 Claims, 23 Drawing Sheets

U.S. PATENT DOCUMENTS

| | | | | |
|---|---|---|---|---|
| 4,922,608 | A | 5/1990 | Pahl | |
| 5,007,168 | A | 4/1991 | Messinger et al. | |
| 5,577,324 | A * | 11/1996 | Tanaka | 30/43.6 |
| 5,704,126 | A * | 1/1998 | Franke et al. | 30/34.1 |
| 6,226,871 | B1 * | 5/2001 | Eichhorn et al. | 30/43.92 |
| 2002/0108251 | A1 | 8/2002 | Brum et al. | |
| 2004/0010919 | A1 * | 1/2004 | Shiba et al. | 30/43.92 |
| 2004/0128834 | A1 * | 7/2004 | Royle | 30/43.92 |

FOREIGN PATENT DOCUMENTS

| | | | |
|---|---|---|---|
| JP | 06-343776 | A1 | 12/1994 |
| JP | 10-043443 | A1 | 2/1998 |
| WO | WO-00/38891 | A2 | 7/2000 |

* cited by examiner

DRY SHAVER WITH A CRADLE SHAVING HEAD

TECHNICAL FIELD

The present invention relates to a dry shaver with a cradle shaving head, and more particularly to the shaver having the cradle shaving head tilting about a thickness axis of a shaver for enhanced smooth shaving contact with a user's skin.

BACKGROUND ART

A shaver with the cradle shaving head is known in the art, for example, in Japanese Patent Early Publication No. 6-343776 in which the cradle head carrying shaving units is mounted on top of a hand grip and is allowed to tilt about a thickness axis of the hand grip. A motor for driving inner cutters of the shaving units is attached to the lower end of the cradle head, and projects into an upper interior space of the hand grip. Since the motor tilts together with the cradle head, the hand grip is required to give a relatively wide dimension to the upper interior space for accommodating the tilt movement of the motor, thereby necessitating also a wide dimension to the hand grip which is a hindrance to making the shaver compact enough to be comfortably grasped by the user's hand.

Another prior art is disclosed in Japanese Patent Early Publication No. 10-43443 which discloses a like dry shaver with a cradle shaving head. The dry shaver has a hand grip of a reduced width dimension within which the motor is allowed to tilt together with the cradle head. However, the hand grip of the reduced width dimension limits the tilt movement of the motor and therefore of the cradle head, only leaving a relatively narrow angular range in which the cradle head is permitted to tilt with restricted capability of following the contour of the user's skin.

Further, Japanese Patent Early Publication No. 4-269992 discloses a like dry shaver with a cradle shaving head carrying a shaving unit. The cradle shaving head is supported to a hand grip to be capable of tilting about an axis. Also in this prior art, the motor for driving the inner cutter of the shaving unit is carried on the cradle head and projects into an upper part of the hand grip, thereby restricting the angular range of the tilting movement or necessitating unduly wide dimension for the hand grip.

Further, WO 00/38891 discloses a like dry shaver having a cradle shaving head. The cradle head incorporates the motor and is supported on top of a hand grip to be capable of tilting about a tilt axis without causing the motor to interfere with the hand grip, giving a wide range of tilting movement to the cradle head. However, the cradle head incorporating the motor is supported at its upper end to the hand grip to define the tilt axis upwardly of a mass center of the cradle head with respect to a height of the shaver. With this result, the weight or gravitational force acting on the cradle head functions to keep the cradle head to a neutral position when the hand grip is held upright, which is a comfortable operating position as the user is not required to raise ones's elbow and is free from fatigue which would otherwise mounts during an extended shaving operation. That is, as the cradle head tilts about the axis with the shaver being held substantially upright, a counter torque appears to impede the tilt movement, thereby making it not easy to tilt the cradle head to a greater extent, while the user moves the cradle head across the skin with the hand grip being held substantially upright. Therefore, the user has to keep one's elbow raised in order to make the cradle inclined for smooth contact with various face areas of the skin for shaving the face, at the expense of the accumulation of the fatigue.

This is true also for the prior art shaver disclosed in the above mentioned three Japanese Patent Publications. Accordingly, it is desired to provide a dry shaver which is capable of tilting the cradle head easily and largely for smooth shaving contact with the user's skin, while permitting the user to handle the shaver comfortably with a hand grip held substantially upright or without requiring to raise one's elbow to a greater extent.

DISCLOSURE OF THE INVENTION

The present invention has been accomplished in view of the above problem to provide an improved dry shaver having a cradle shaving head which assures a smooth and efficient shaving, yet with a comfortable handling. The shaver in accordance with the present invention includes a hand grip adapted to be grasped by a user's hand and having a thickness axis and a height axis. Mounted on top of the hand grip is a cradle head which carries at least one shaving unit composed of an outer cutter and an inner cutter driven to move in hair-sharing engagement with the outer cutter. A support mechanism is provided to support the cradle head to the hand grip in such a manner as to allow the cradle head to tilt relative to the hand grip about at least one tilt axis extending parallel to the thickness axis of the hand grip. The cradle head also carries a motor for driving the inner cutter so as to tilt together with the motor relative to the hand grip. The characterizing feature of the present invention resides in that at least one portion of the motor projects upwardly of the tilt axis, whereby the cradle head is given overall mass center (M) which is located upwardly of the tilt axis (S) with respect to the height axis of the hand grip.

Accordingly, the motor of generally heavy nature can be best utilized to locate the overall mass center (M) of the cradle head above the tilt axis (S) for generating a torque acting to tilt the cradle head from a neutral position about the tilt axis when the hand grip is held upright. Thus, the cradle head can be easy to be inclined for brining the shaving unit into smooth shaving contact with various areas of the skin while keeping the hand grip substantially upright, enabling the user to perform a smooth and efficient shaving, while keeping ones' hand relaxed.

Preferably, the support mechanism gives two tilt axes which are spaced in a width direction of the hand grip so as to allow the cradle head to tilt about either one of the tilt axes, making it possible to give a sophisticated tilting movement to the cradle head for improved smooth contact of the shaving unit with various areas of the skin.

In a preferred embodiment, the cradle head is elongated to have a width along the elongated direction and are supported to the hand grip at two tilt axes which are spaced along the width of the cradle head by a distance less than a half of the width of the cradle head. Thus, the elongated cradle head can be easy to make the sophisticated tilt movement for brining the shaving unit into smooth contact with the skin.

The support mechanism is arranged to floatingly support the cradle head to the hand grip so that the cradle head can be depressed with an attendant vertical movement of the tilt axes. Therefore, the cradle head can tilt at differently depressed positions to further improve the capability of bringing the shaving unit into smooth contact with the user's skin, yet realizing a suitable contact pressure for assuring effective shaving. For this purpose, the support mechanism includes a spring means which gives a biasing force to urge the cradle head towards an undepressed position or neutral poison where the cradle head has its width axis kept substantially perpendicular to the height axis of the hand grip.

The support mechanism is preferred to include an adjustor which acts on the spring means to vary the biasing force, thereby adjusting the contacting pressure of the shaving unit against the user's skin. The adjustor may be additionally provided with a locking function of locking the cradle head to the neutral position. Alternatively, the support mechanism may be given the same locking function without being accompanied with the pressure adjusting function.

The cradle has a casing which is separately formed from the hand grip and accommodates therein the motor. The casing is coupled to the hand grip at such a position that the overall mass center of the cradle head is located upwardly of the tilt axes along the height axis of the hand grip. The hand grip has an interior space within which the battery for the motor is received, and has a top wall closing the upper end of the interior space. The cradle head has its lower end entirely spaced upwardly of the top wall, thereby avoiding interference of the cradle head with the hand grip, assuring a wide range of the tilt movement for the cradle head.

The hand grip accommodates a driving circuit together with the battery for driving the motor. The driving circuit is connected to the motor by means of a flexible cable for permitting the tilt movement of the motor incorporated cradle head.

The hand grip is preferred to have a top guard which projects to overlap the lower end of the cradle head in order to protect the cradle head from moving in directions not associated with the tilt and the depressing movement. In order to add smooth tilting and depressing movement to the cradle head, the top guard is provided with a guide which comes into slidable engagement with a portion of the cradle head.

Preferably, the cradle head as well as the hand grip are made watertight with a sealing sheath fitted around the cable over the entire length thereof inclusive of the connections respectively with the cradle head and the hand grip, thus making the whole shaver water-tight. In this connection, the supporting mechanism is arranged outside of water-tight spaces of the cradle head and the hand grip. Thus, the supporting structure including moving parts can be isolated from the water-tight structure, which in turn makes it easy to design the water-tight structure of the cradle head and the hand grip.

The cradle head is formed on its opposite width ends respectively side extensions each being cooperative with a corresponding upper width end of the hand grip to define therebetween a gap. The gap which is opened at an outer width end and closed at an inner width end, and is made greater towards the outer width end than at the inner width end. With the provision of thus configured gaps between the cradle head and the hand grip on opposite sides thereof, the cradle head is permitted to tilt or be inclined over a wide angular range for bringing the shaver unit in smooth and effective shaving contact with various areas of the skin while holding the grip substantially upright or at a small angular deviation.

The side extensions may be formed respectively with release buttons for detaching the outer cutter from the cradle head when pressed. In this case, the release button is preferred to have its lower end pivoted to the lower end of the side extension to pivot about an axis extending the thick direction of the cradle head. Each release button is formed at its upper end with a hook for detachable engagement with the outer cutter. Thus, the release button is activated to detach the outer cutter only responsive to forces being applied by the fingers of the user grasping the hand grip in definite directions, i.e., the sideward forces acting to press the upper end of the release button. This means that, although the provision of the gap certainly causes the user to place the fingers in touch with the lower ends of the side extensions while manipulating the shaver, the release buttons can be well protected from being activated by such simple touch of the fingers on the buttons.

The cradle head may carry a plurality of the shaving units each being elongated to have width axis in parallel with the widthwise axis of the cradle head. At least one of the shaving units is floatingly supported at its opposite width ends to the cradle head such that at least one shaving unit is capable of being inclined against a spring bias with its width axis being angled with respect to the widthwise axis of the cradle head as well as of being vertically depressed against the spring bias with its width axis kept in parallel with the widthwise axis. The spring bias of urging at least one shaving unit relative to the cradle head is set to be lower than that of urging the cradle head relative to the hand grip. Thus, the shaving unit alone can move when pressed slightly against the user's skin and subsequently move together with the cradle head as the skin contact pressure increases. With this result, the shaving unit can be adjusted its orientation and/or skin contacting pressure independently of and jointly with the movement of the cradle head relative to the hand grip for optimum shaving contact with various areas of the user's skin. In this connection, all the shaving units can be movably supported to the cradle head so as to be capable of being inclined and depressed independently from each other, making it easy to place the individual shaving units for optimum shaving contact with skin portions of varying surface configurations.

Preferably, the cradle head is also supported floatingly to the hand grip to be capable of being depressed against a spring bias which is greater than that for urging the shaving unit relative to the cradle head. Thus, the shaving unit can be depressed alone and jointly with the cradle head so as to give a corresponding skin contact pressure varying over a wide range for optimum shaving contact.

These and still other advantageous features of the present invention will become more apparent from the following detailed description of the preferred embodiments when taken in conjunction with the attached drawings.

MODES FOR CARRYING OUT THE INVENTION

First Embodiment

FIGS. 1 to 21

Figure 1:
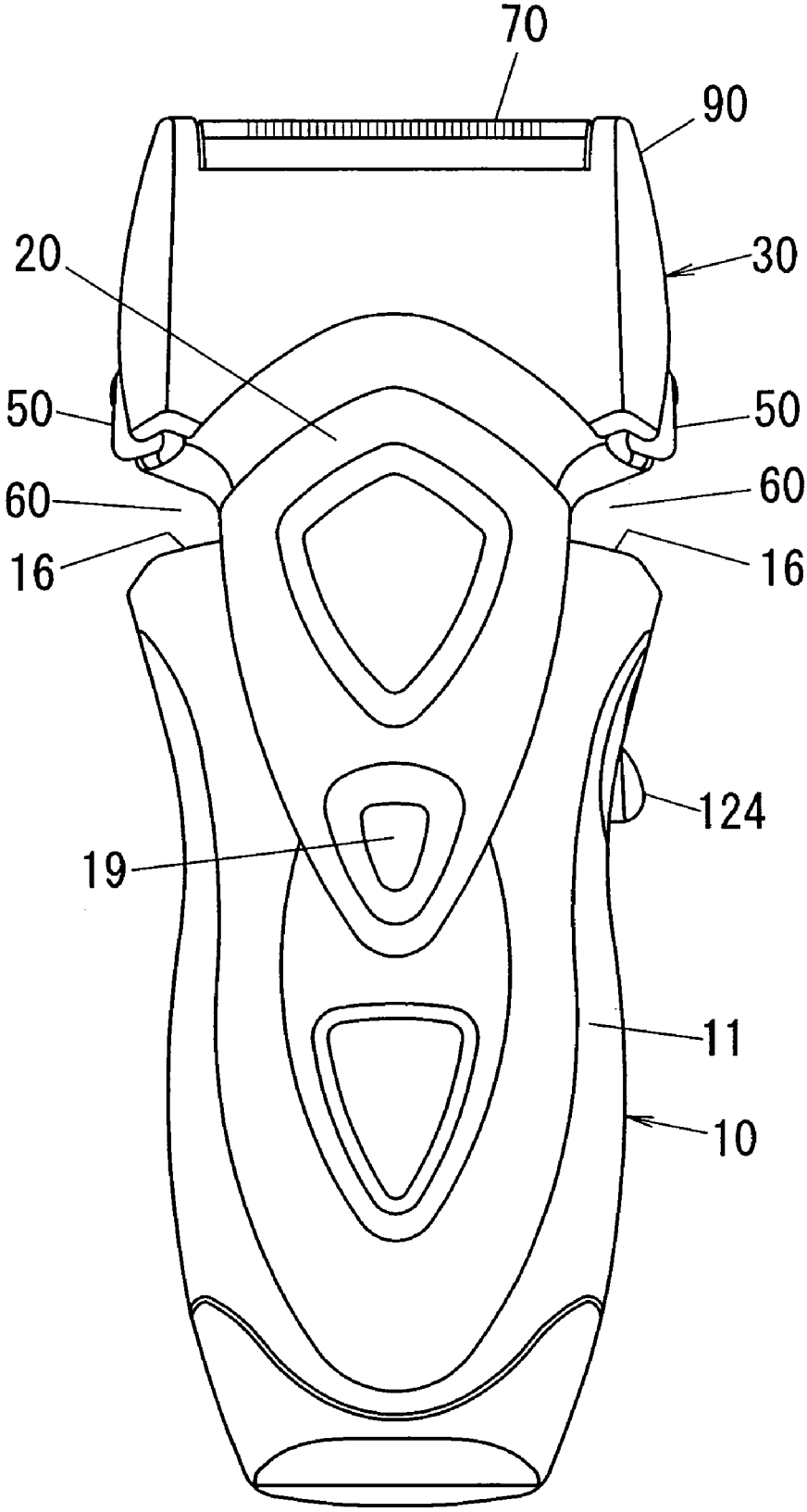
FIG. 1 is a front view of a dry shaver in accordance with a first embodiment of the present invention.
Figure 2:
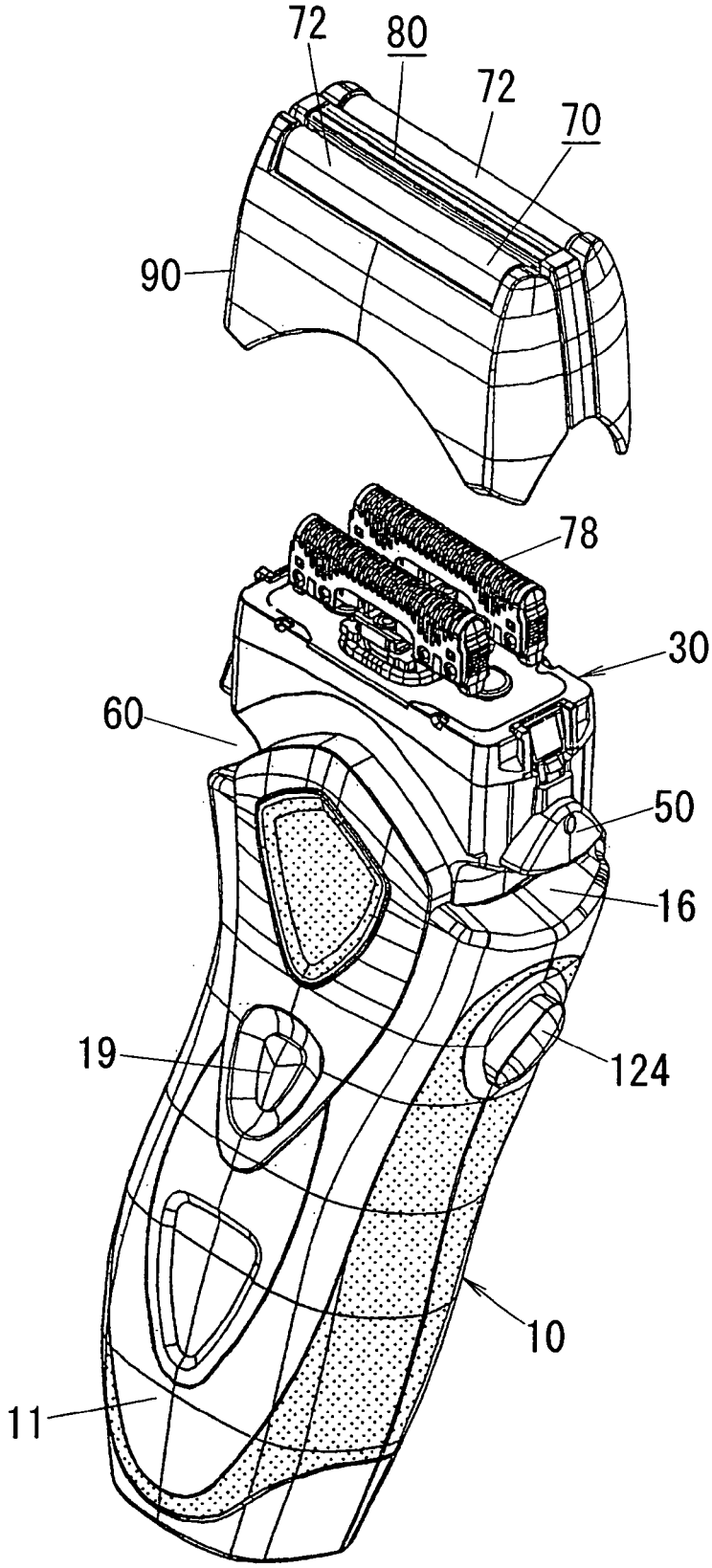
FIG. 2 is an exploded perspective view of the above shaver.

Referring now to FIGS. 1 to 5, there is shown a dry shaver in accordance with a first embodiment of the present invention. The shaver comprises a hand grip 10 configured to be grasped by a user's hand, and a cradle head 30 carrying three parallel shaving units 70 and 80. Two outer ones of the shaving units 70 are designed for shaving relatively short hairs and each includes an outer cuter 72 in the form of an arcuately curved perforated foil and an inner cutter 78 driven to reciprocate in shearing contact with the outer cutter. The other center shaving unit 80 is designed for shaving relatively long hairs and includes an outer cutter 82 in the form of a slotted piece and an inner cutter 88 driven to reciprocate together with the inner cutters 78 in shearing engagement with the outer cutter 61. The outer cutters 72 of the two outer shaving units 70 and the center shaving unit 80 are integrated into a cutter holder 90 which is detachably coupled to the cradle head 30. The inner cutters 78 are detachably connected respectively to reciprocating drive elements 42 projecting on top of the cradle head 30. When the cutter holder 90 is attached to the cradle head 30, the inner cutter 88 of the center shaving unit 80 is drivingly connected to one of the drive elements 42 so as to reciprocate together with the other inner cutters 78. The details of the cutter holder 90 will be discussed later with reference to FIG. 9. Also carried on the rear of the cradle head 30 is a trimmer block 170 having a reciprocating inner cutter driven together with the above inner cutters 78 in shearing engagement with an associated outer cutter for trimming hairs.

Figure 4:
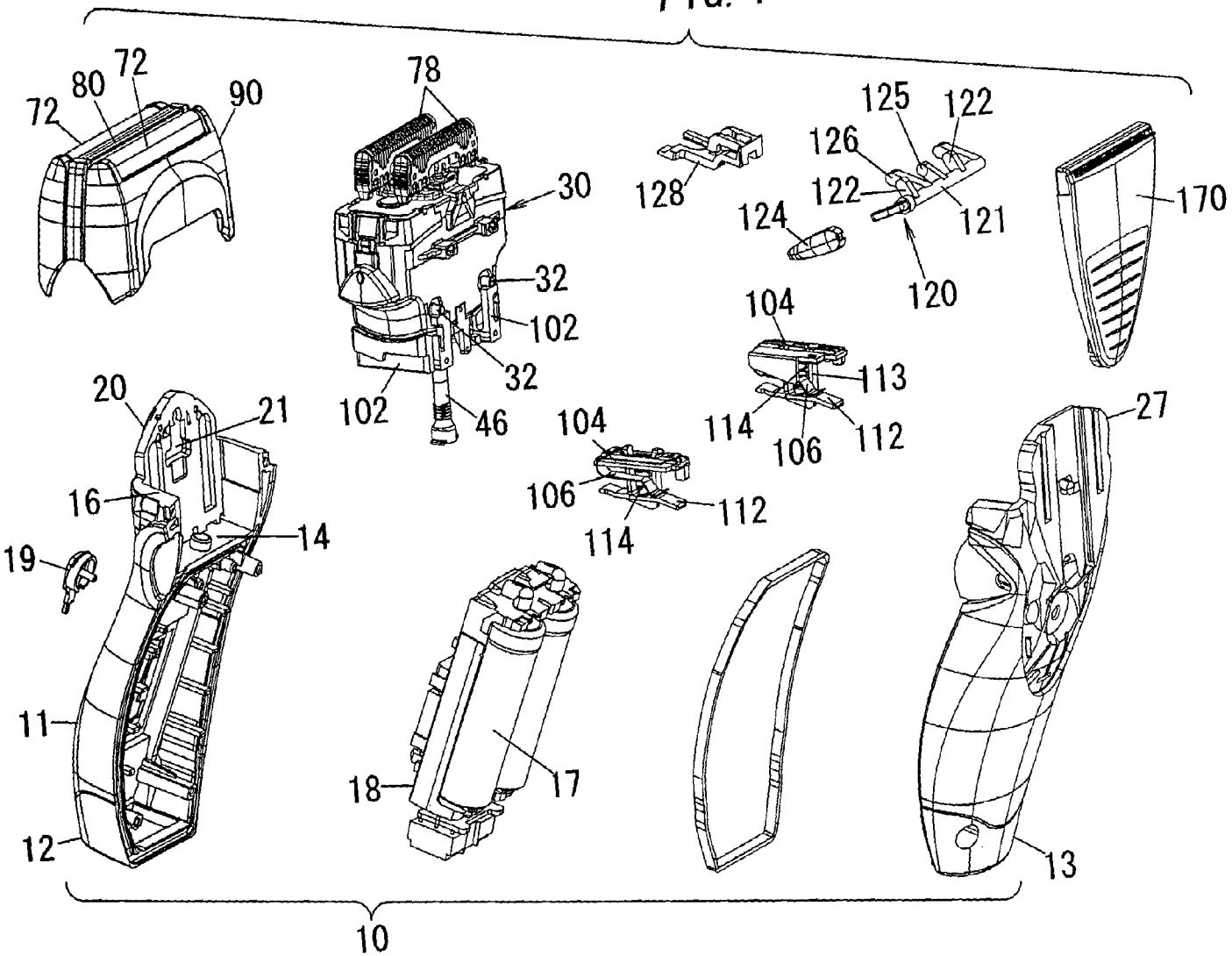
FIGS. 4 and 5 are exploded perspective views of the above shaver.
Figure 5:
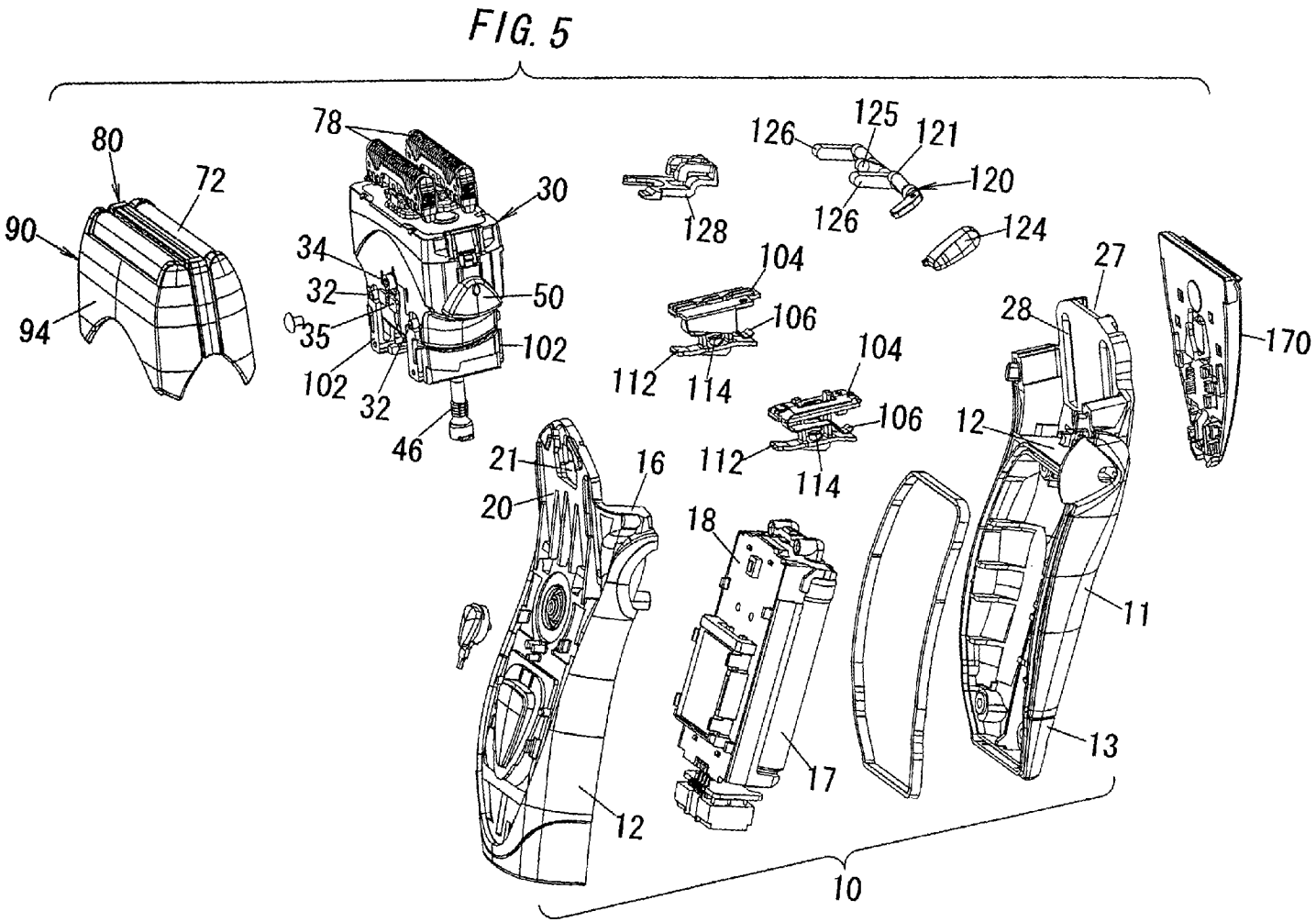
Figure 6:
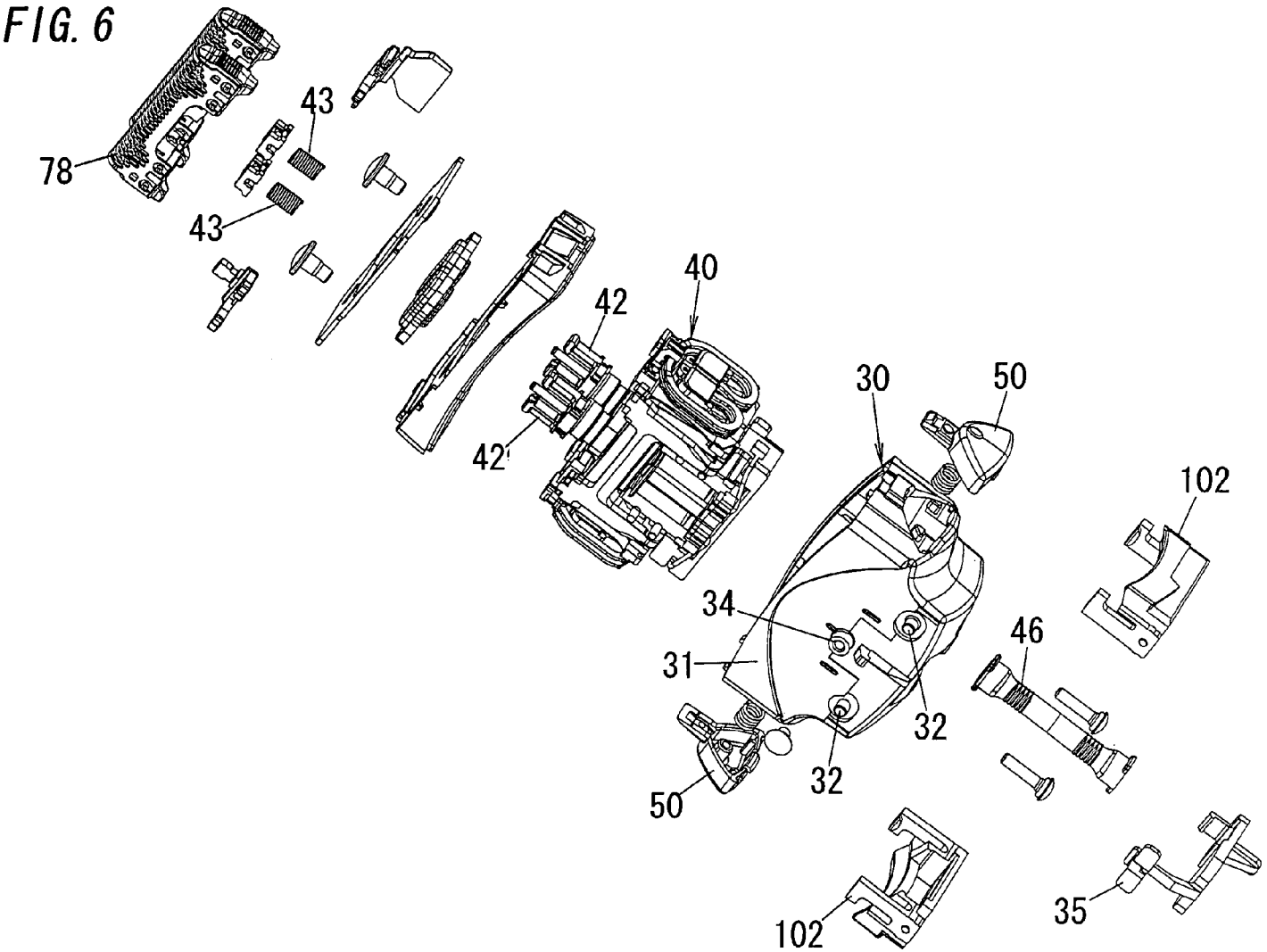
FIG. 6 is an exploded perspective view of a cradle head of the above shaver.

The hand grip 10 is vertically elongated to have a height axis and includes a water-tight housing 11 which accommodates therein rechargeable batteries 17 as well as a circuit board 18 mounting electronic components realizing a driving circuit for driving the inner cutters and a charging circuit for the batteries. A switch button 19 is disposed in a curved recess on front of the hand grip 10 to activate the driving circuit for energizing a motor 40 to reciprocate the inner cutters. As best shown in FIGS. 4 and 5, the housing 11 is made up from a front housing half 12 and a rear housing half 13 which are mated together to form therebetween a water-tight space for the batteries 17 and the circuit board 18. The housing halves are formed at the respective upper ends with top plates which are cooperative to define a top wall 14 closing the upper end of the water-tight space.

The cradle head 30 is elongated along its width axis to have a width greater than a height thereof. It is the width axis along which the inner cutters reciprocate for shaving the hairs. The cradle head 30 a water-tight casing 31 accommodating therein the motor 40 which is electrically connected by means of a flexible cable 44 to the driving circuit formed in the hand grip. The motor 40 is a linear reciprocating motor having two reciprocators carrying the drive elements 42 projecting on top of the cradle head 30. The casing 31 is formed separately from the hand grip 10 and is movably supported thereby by a support mechanism 100 so as to be capable of effecting a combination of tilting and depressing movements relative to the hand grip 10, as shown in FIGS. 10 to 13, in order to bring the shaving units 50 and 60 into smooth and effective shaving contact with various areas of the user's skin.

Figure 3:
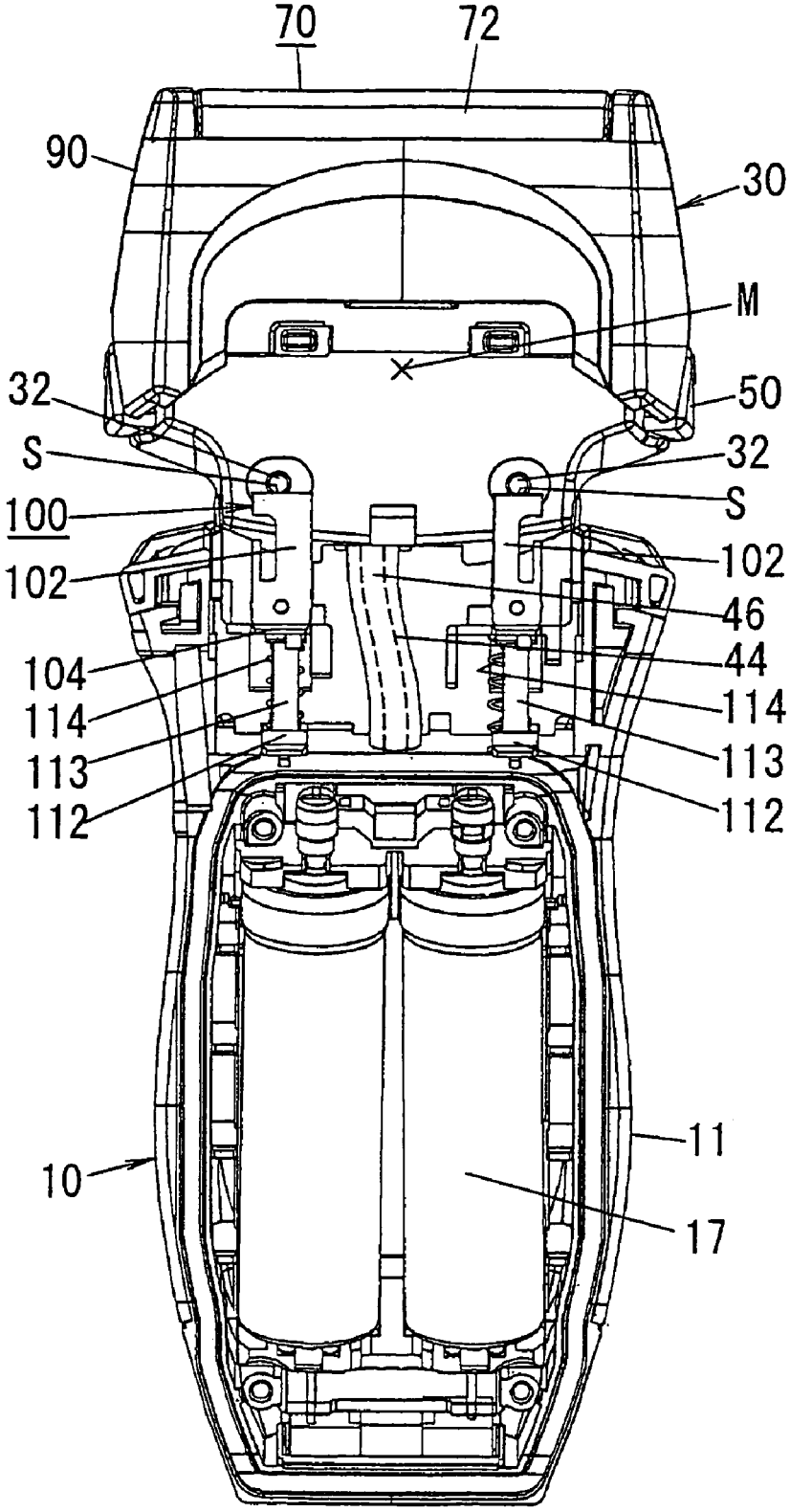
FIG. 3 is a front view, partly in section, of the above shaver.

As shown in FIG. 3, the supporting mechanism 100 includes a pair of levers 102 depending from the lower end of the cradle head 30, and a pair of anchors 112 which are secured to the upper end of the hand grip 10 and have vertical rods 113 respectively upstanding from the anchors 112. The levers 102 abut at their upper ends respectively against pins 32 projecting on the lower end of the cradle head 30 at points spaced along the width axis of the cradle head so that each lever 102 can move in conjunction with respective ones of the tilt axis S, S that extend parallel to the thickness axis of the hand grip 10. The lower end of each lever 102 is slidably engaged with each of the vertical rods 113 with a coil spring 114 interposed between the lever 102 and the anchor 112. In detail, as shown in FIGS. 4 and 5, each lever 102 is fitted at its lower end with a shoe 104 which is assembled together with the anchor 112 into a single module to be mounted on top of the hand grip 10. The vertical rod 113 extends slidably through the shoe 104 and is retained thereby with the coil spring 114 placed between the shoe 104 and the anchor 112. When the shoe 104 is fitted to the lower end of the lever 102, the vertical rod 113 is allowed to extend through the lower end of the lever so that the lever 102 is slidable along the vertical rod 113. Thus, each lever 102 is cooperative with the vertical rod 113 of the anchor 112 to define a compressible bar which supports the cradle head 10 floatingly on top of the hand grip 10, allowing the cradle head 30 to be depressed from a neural position against a bias of the coil springs 114. At the neutral position or undepressed position, the cradle head 30 has its width axis kept perpendicular to the height axis of the hand grip 10, as shown in FIG. 1.

Figure 7:
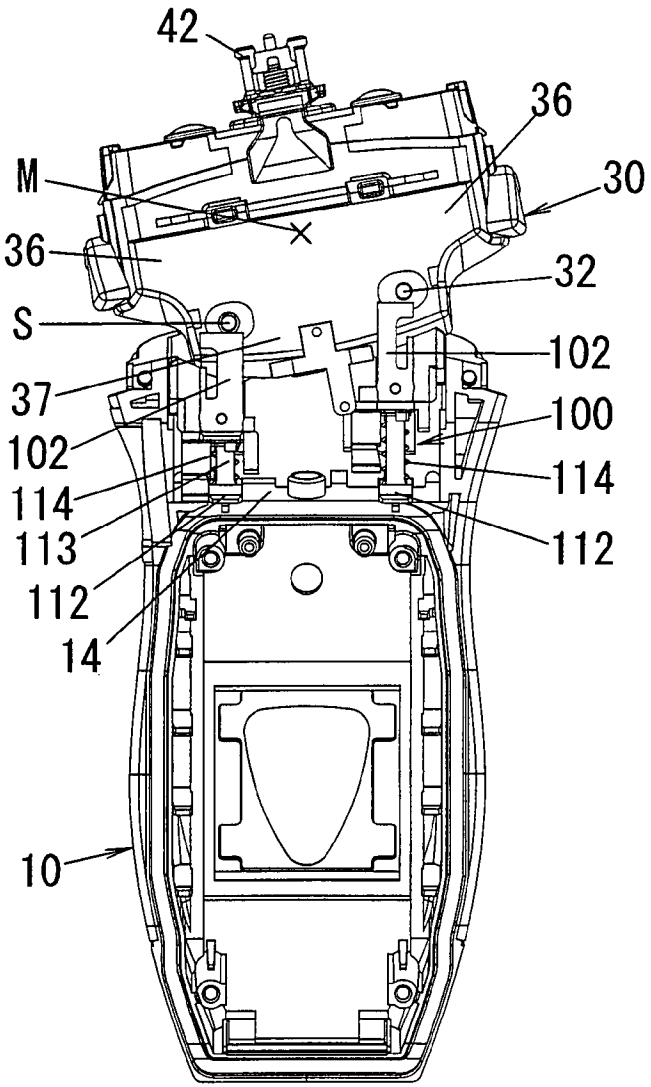
FIG. 7 is a front sectional view of the above shaver shown with the cradle head inclined.

Further, the levers 102 contact at their respective upper ends to the cradle head 30 with some tolerance given about at least one of the pins 32 such that the cradle head 30 can tilt about either one of the pins 32 or the tilt axis S of the corresponding one of the levers 102, while lowering the other lever 102 with associated compression of the coil spring 114. Whereby, the cradle head 30 is allowed to tilt in either directions with associated inclination of the shaving units 70 and 80 relative to the height axis of the hand grip 10, as shown in FIG. 7. Because of that the tilt movement of the cradle head 30 is accompanied with the compression of the coil spring 114, the shaving units are given a suitable contact pressure as the cradle head 30 is angled. Also, because of that each lever 102 is vertically movable, the cradle head 30 is allowed to tilt about either of the vertically displaced tilt axis S, that is, the cradle head 30 can tilt at a varying depressed position.

Since the cradle head 30 tilts at its lower end relative to the levers 102 and incorporates the entire motor 40 of heavy nature, the cradle head 30 is given an overall mass center M which is located upwardly of the tilt axes S defined respectively at the upper ends of the levers 102, as shown in FIG. 7. With this result, upon seeing a slight deflection of the cradle head 30 in either direction from the neutral position with the hand grip 10 held upright, the gravitational force acting on the cradle head 30 will produce a torque about the tilt axis S for deflecting the cradle head 30 further, thereby facilitating the tilt movement of the cradle head and therefore bringing the shaving units into smooth and effective shaving contact with the skin. The distance between the tilt axes S is selected to be half or less than a maximum width of the cradle head 30 to effect the combination of the tilting and depressing movements in match with a comfortable and effective shaving performance over various face areas. It is noted in this connection that the overall mass used herein is intended to denote the mass of a whole body tilting relative to the hand grip 10 and therefore include all the parts mounted on the cradle head 30 including the shaving units 70 and 80.

The support mechanism 100 is disposed exteriorly of the water-tight spaces of the cradle head 30 and the hand grip 10. That is, the levers 102 abut against the pin 32 external to the casing 31 of the cradle head 30 and the anchors 112 are secured to the hand grip 10 upwardly of the top wall 14 closing the upper end of the water-tight housing 11 of the hand grip 10. With this arrangement, the cradle head 30 and the hand grip 10 are not required to include the support mechanism 100 having the moving parts interconnecting the cradle head and the hand grip, and accordingly can be easily designed to be water-tight. The flexible cable 44, which is provided for electrical connection of the motor 40 with the circuit board 18, is covered over an entire portion exposed between the cradle head 30 and the hand grip 10 with a water-tight sheath 46 which is sealed both at the connections with the cradle head 30 and the hand grip 10. Further, the cradle head 30 has its lower end entirely spaced upwardly of the top wall 14 closing the upper end of a water-tight interior space of the hand grip 10. Thus, the cradle head 30 incorporating the motor 40 can effect tilting movement free from interfering with the hand grip 10 and is therefore given a wide angular range for the tilting movement.

As shown in FIG. 4, each shoe 104 carries a U-shaped leaf spring 106 which is normally kept inactive but becomes active to give a spring force which is additive to that of the coil spring 114 for adjusting the resulting contact pressure given to the shaving units. For this purpose, the support mechanism 100 includes an adjustor 120 having a shaft 121 with actuators 122 and an operating knob 124, as shown in FIGS. 4 and 5. The shaft 121 extends in the width direction above the top wall 14 of the hand grip 10 and is caused to rotate about a horizontal axis by manipulating the knob 124 disposed on one side of the hand grip 10. The shaft 121 includes a latch bar 125 and is clicked into three positions by engagement of the latch bar 125 with a retainer 128 secured to the hand grip 10 between the anchors 112. The first one is a normal position in which the actuators 122 are kept away from the spring 106 irrespective of the tilting and depressing movement of the cradle head 30 relative to the hand grip 10, thereby giving no additional spring bias against the movements of the cradle head. The second one is a strong position in which the actuators 122 come into engagement respectively with the springs 106, causing the springs 106 to be compressed as the cradle head 30 is depressed or tilts, and therefore giving the additional spring bias. The third one is a lock position in which lock bars 126 of the shaft 121 engage respectively with the shoes 104 of the levers 102 so as to lock the cradle head 30 immovable at the neutral position.

Figure 8:
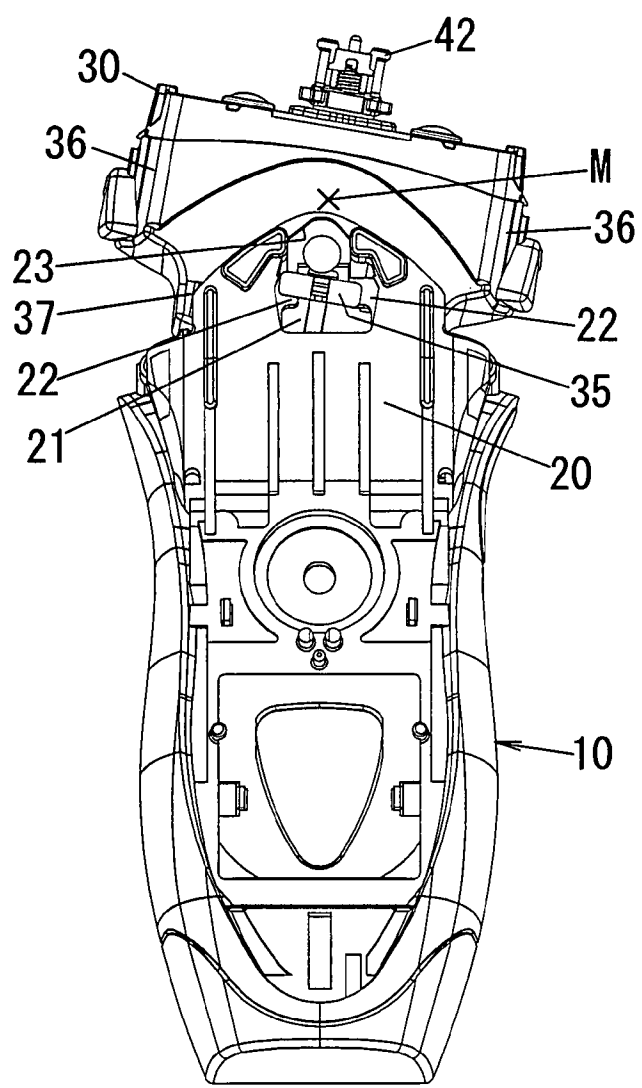
FIG. 8 is a front view of the above shaver shown with the cradle head inclined.

Also as shown in FIGS. 4 and 5, the hand grip 10 is formed with a front top guard 20 and a rear top guard 27 projecting upwardly from the top wall 14 of the housing 11 in an overlapping relation with the cradle head 30 so as to protect the cradle head 30 from tilting forward or backward. The front top guard 20 is formed with a vertically elongated opening 21 with a pair of inward tabs 22 and an arcuately curved top edge 23, while the rear top guard 27 is formed with a pair of vertical slits 28. The cradle head 30 is formed on its front face with a guide pin 34 and a guide piece 35 which extend into the openings 21 to be movable therein while the cradle head 30 effects the tilting and depressing movements. The guide piece 35 has its one portion overlapped on the tabs 22 in a slidable relation thereto, as shown in FIG. 8, for smoothly guiding the movements of the cradle head 30. The vertical slits 28 in the rear top guard 27 receives therein portions of the levers 102 to guide the vertical movement thereof. The upper end of the vertical slits 28 and the upper end of the opening 21 are responsible for abutting against the levers 102 and the pin 34 and therefore are cooperative to act as a stopper for retaining the cradle head 30 at the neutral position in the absence of an external force.

Turning back to FIG. 1, the shaver is configured to give a pair of side gaps 60 each being closed at its inner width end and opened at its outer width end. The gap distance is made greater towards the outer width end than at the inner width end in order to accommodate the tilting and the depressing movements of the cradle head, particular to give a wide range of the angular displacement or the tilting movement accompanied by the depressing movement. As best shown in FIGS. 7 an 8, the cradle head 30 is configured to have side extensions 36 at its upper end, and to have a reduced-width neck 37 at its lower end for pivotal connection to the supporting mechanism 100. The hand grip 10 is formed with inclined shoulders 16 which are disposed upwardly of the top wall 14 but below the upper end of the top guards 20 and 27, and define therebetween a space for receiving the lower end of the neck 37 when the cradle head 30 is depressed. The side extension 36 is cooperative with the opposed shoulder 16 to give the gap 60 of which inner width end is closed mainly by the neck 37. When the cradle head 30 is inclined to a maximum extent or is held in the neutral position, an upper end portion of the lever or levers 102 becomes exposed to the inner width end of the gap or gaps 60 to close the same. It is noted in this connection that the gap 60 still remains when the cradle head 30 is inclined or depressed to its maximum extent. Because of the provision of this minimum gap and because of the gap geometry having the gap distance becoming greater toward the outer width end, user's finger or other foreign matter accidentally trapped in the gap 60 can be successfully expelled or slipped away from the gap 60 as the gap is caused to be narrower, i.e., the cradle head 30 is inclined or depressed to a greater extent, thereby avoiding entanglement of the user's finger or other foreign matters.

Figure 16:
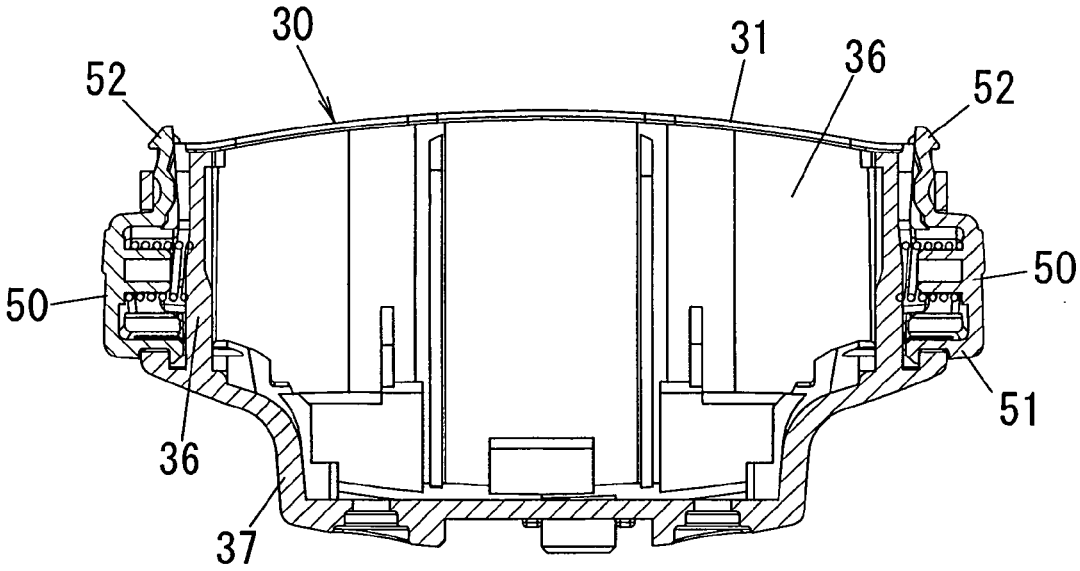
FIG. 16 is a front section of a head casing of the cradle head.
Figure 17:
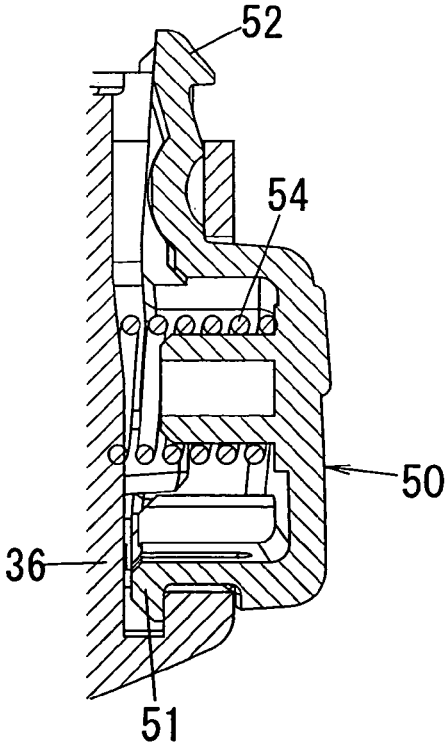
FIGS. 17 and 18 are enlarged views of a portion of the FIG. 16.
Figure 18:
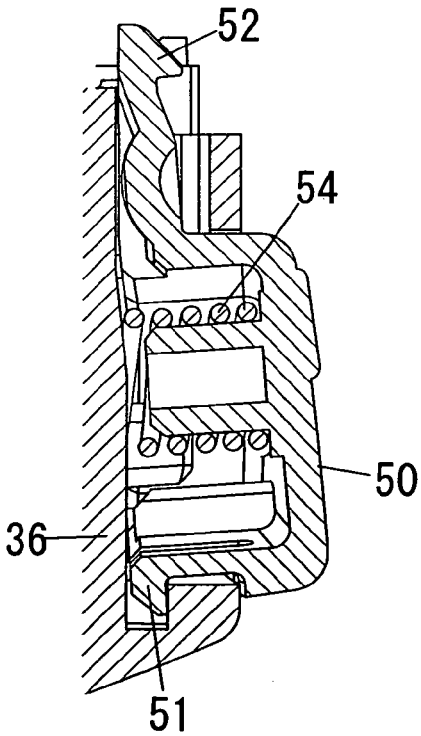
Figure 19:
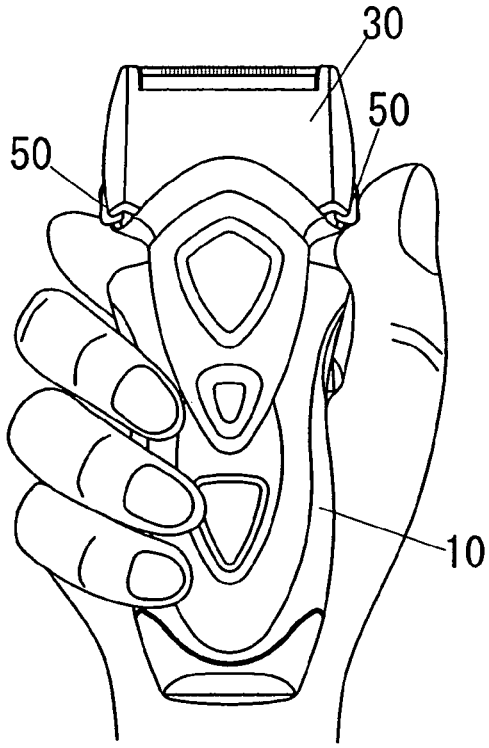
FIGS. 19 and 20 are front views respectively showing manners of gripping the shaver.
Figure 20:
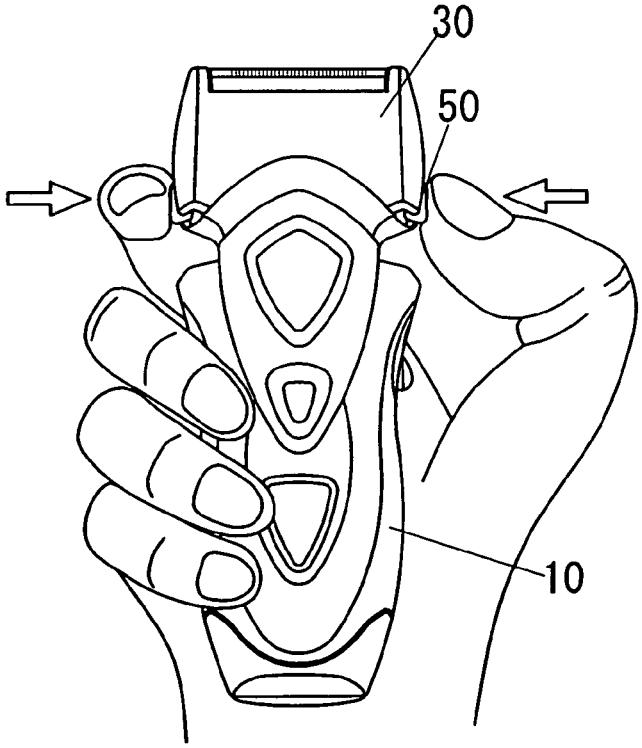
Figure 21:
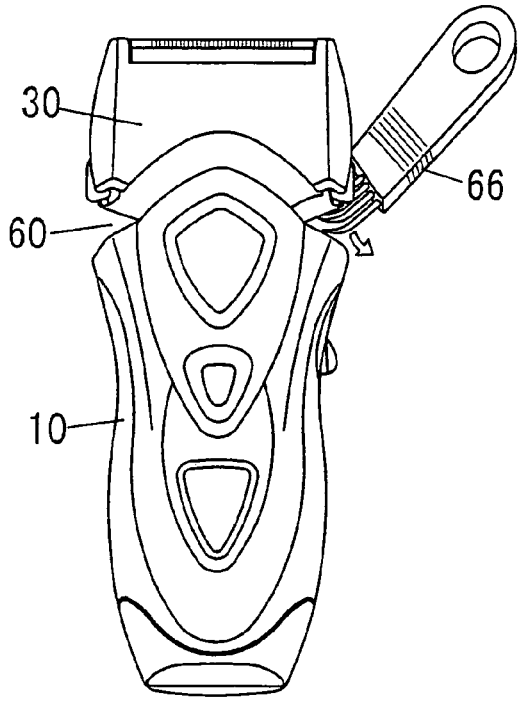
FIG. 21 is a front view showing a manner of cleaning a gap between the cradle head and the hand grip.

With the presence of the gaps 60 at the lower side ends of the cradle head 30, the user is enabled to place the thumb and index finger respectively on the lower ends of the side extensions 36 for supporting or manipulating to the cradle head, as shown in FIG. 19. Thus, the user is easy to handle the shaver while keeping or tilting the cradle head for optimum shaving contact with the various areas of the face. The cradle head 30 is provided at the lower ends of the side extensions 36 respectively with release buttons 50 for detaching the cutter holder 90 from the cradle head 30. Although the release buttons 50 are located at such positions to be very likely in touch with the user's fingers while using the shaver, the release buttons 50 are configured to prevent accidental actuated by the user's fingers, i.e., unintended detachment of the cutter holder 90. As shown in FIGS. 16 to 18, each release button 50 has its lower end 51 engaged to the lower end of the side extension 36 to make a pivoting movement about its lower end, and is formed at its upper end with a hook 52 for detachable engagement with the cutter holder 90. A coil spring 54 is placed between the release button 50 and the cradle head 30 to urge the hook 52 into locking engagement with the cradle head. Detaching of the cutter holder 90 is made by pressing the upper portion of the release button 50 and not the lower end thereof, as shown in FIG. 20. Thus, the user's finger normally expected to be in touch with the lower end of the release button 50 is not likely to press the button for accidental detachment of the cutter holder 90. As shown in FIG. 21, the gaps 60 of the above feature is also useful for cleaning dust out of the gaps by use of a small brush 66.

It should be noted here that although the provision of the gaps 60 between the cradle head 30 and the hand grip 10 is particularly suitable for the above described feature of positioning the overall mass center M of the cradle head 30 above the tilt axes P, it can be equally and advantageously adapted, alone or in combination with the associated scheme of preventing the accidental activation of the release buttons 50, to a shaver having a like cradle head but without the feature of locating the overall mass center above the tilt axis or axes.

Figure 9:
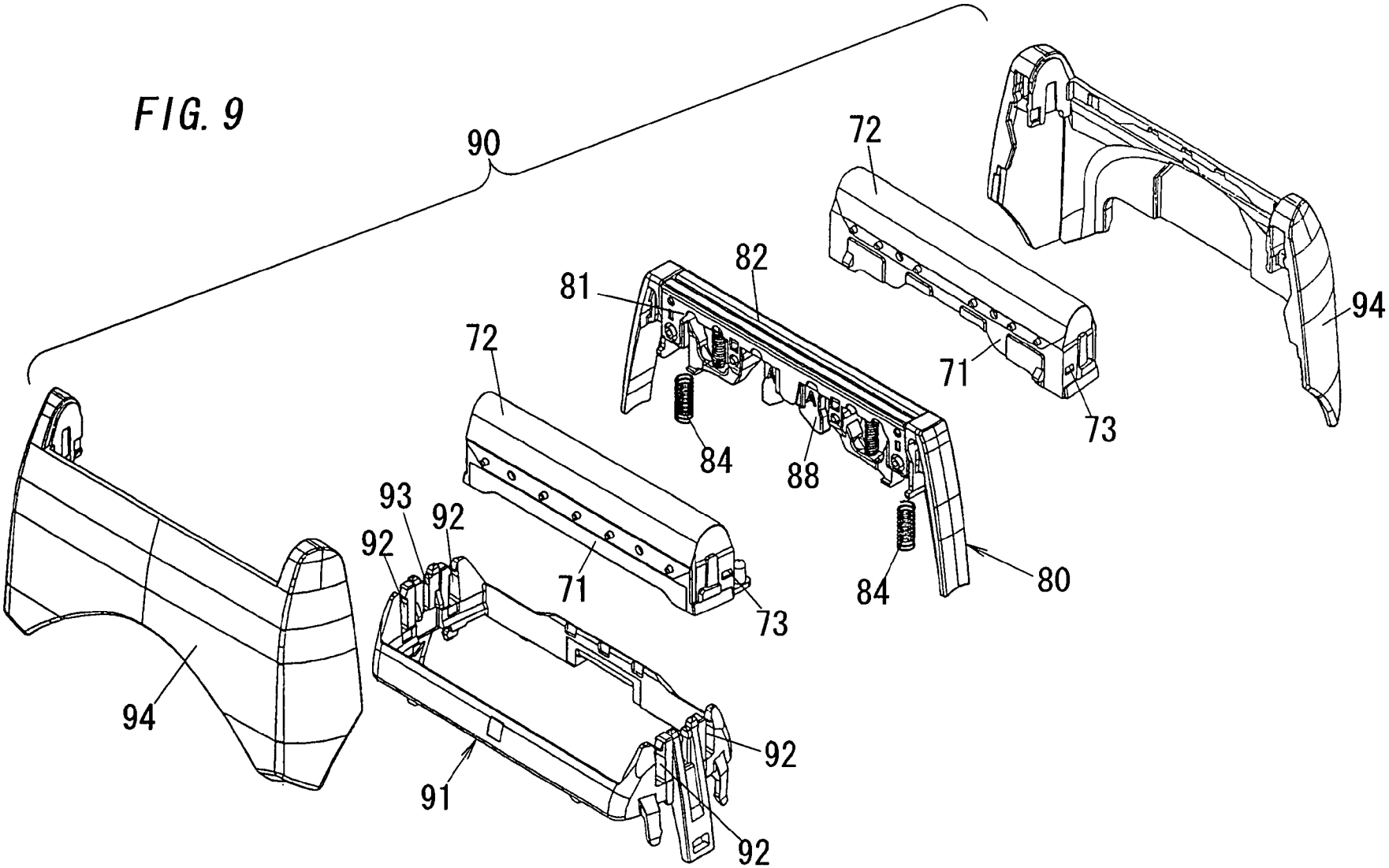
FIG. 9 is an exploded perspective view of shaving units carried on the cradle head.
Figure 10A:
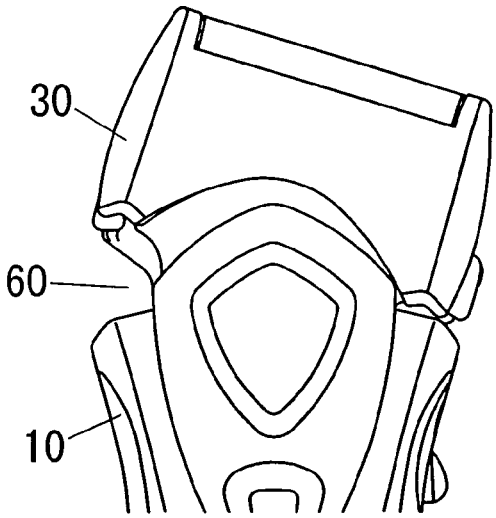
FIGS. 10A and 10B are schematic views showing the inclined cradle head.
Figure 10B:
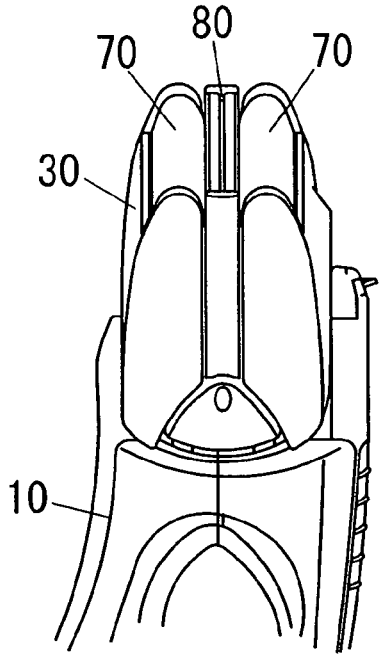
Figure 11A:
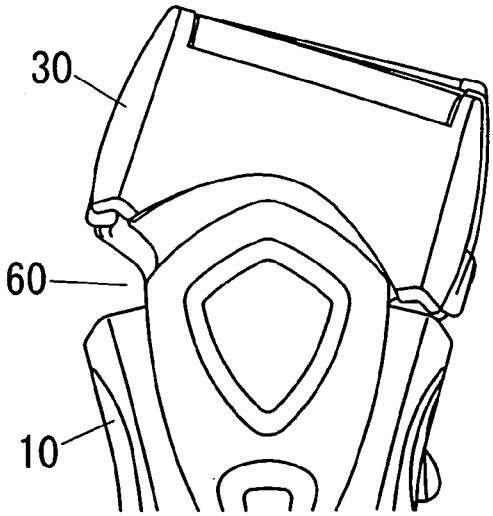
FIGS. 11A and 11B are schematic views showing the inclined cradle head with the shaving units inclined differently.
Figure 11B:
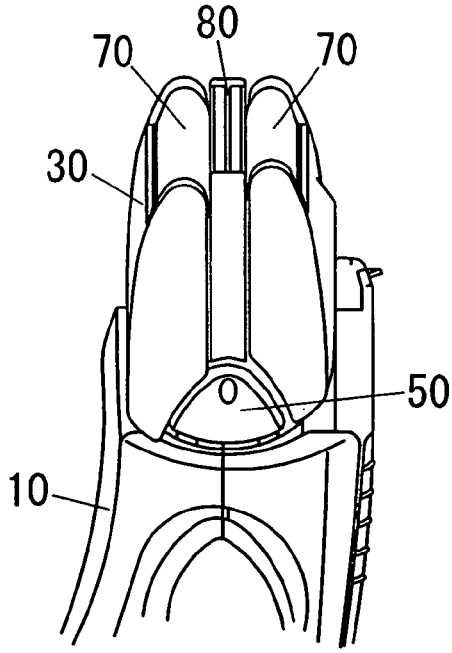
Figure 12A:
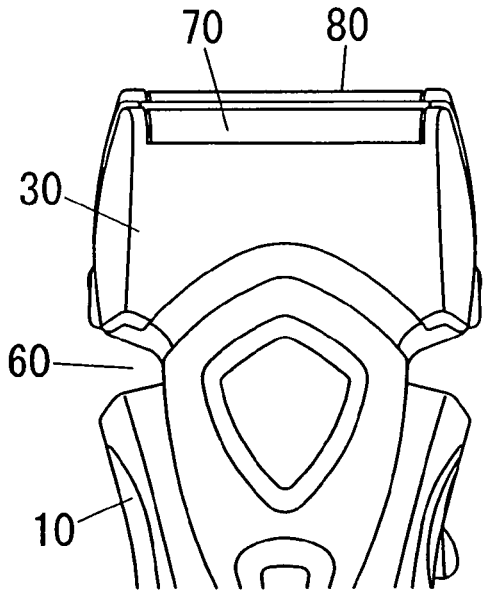
FIGS. 12A and 12B are schematic views showing the cradle head held in its neutral position with the shaving units depressed differently.
Figure 12B:
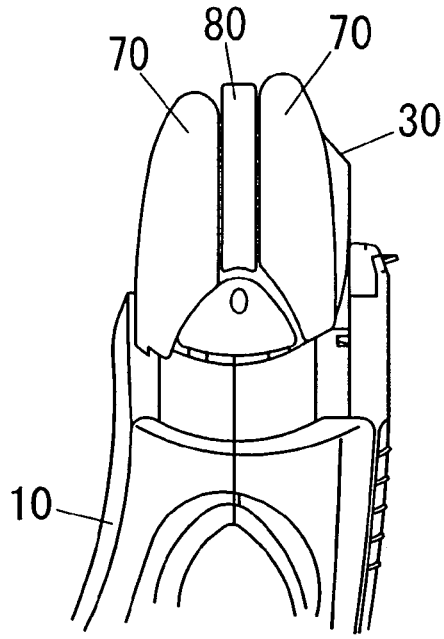
Figure 13A:
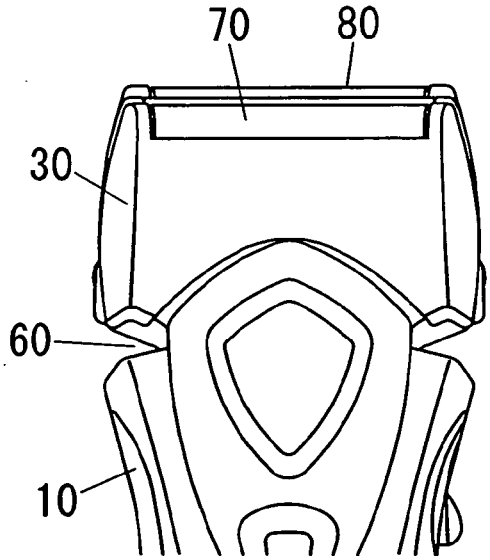
FIGS. 13A and 13B are schematic views showing the depressed cradle head with the shaving units depressed differently.
Figure 13B:
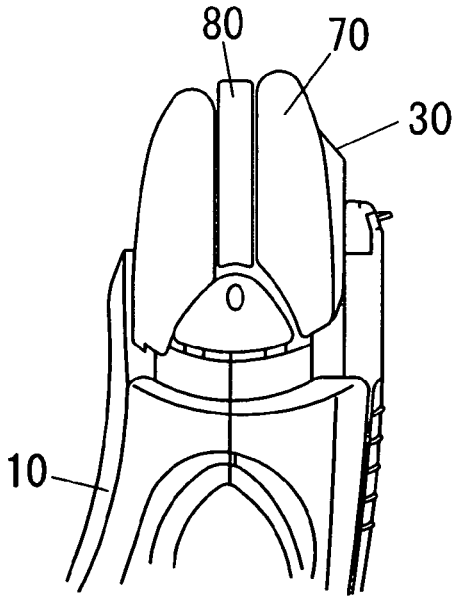
Figure 14:
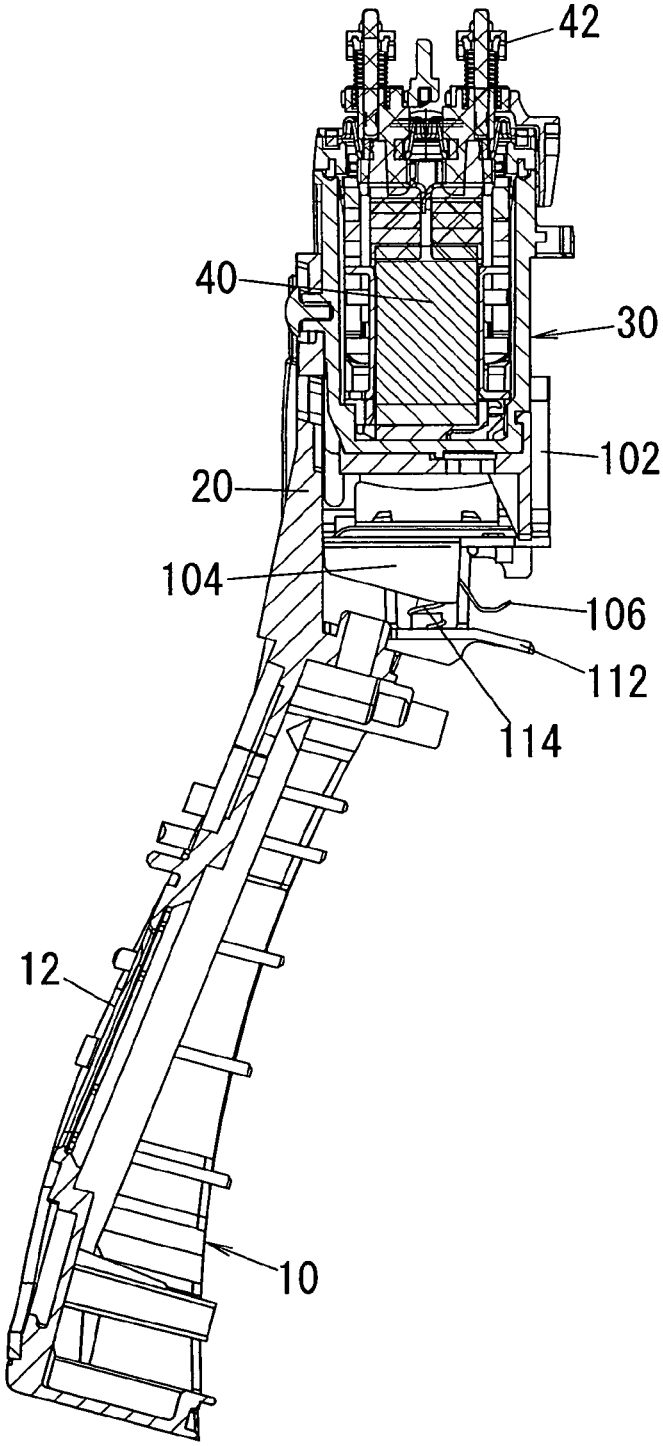
FIG. 14 is a side sectional view of the cradle head and a portion of a hand grip of the above shaver.
Figure 15:
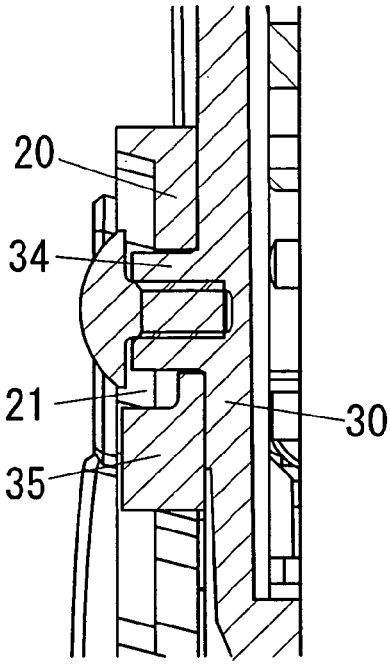
FIG. 15 is an enlarged view of a portion of FIG. 14.

Now referring to FIG. 9, the details of the cutter holder 90 is explained herein. The cutter holder 90 includes a rectangular frame 91 which supports a pair of cassettes 71 each carrying the outer cutter 72 of the short hair shaving unit 70, and the long hair shaving unit 80. Each cassette 71 is formed at its longitudinal ends respectively with studs 73 which are slidably received in vertical slots 92 in the longitudinal ends of the frame 91 so that the cassette 71 or the outer cutter 72 carried thereon is movable at either longitudinal ends relative to the frame 91 and is therefore capable of being depressed and even inclined with respect to the width axis of the cradle head 30. A cover 94 is fixed to each cassette 71 to be movable therewith and conceal a major portion of the cradle head 30 therebehind. The long hair shaving unit 80 includes a chassis 81 which carries the outer cutter 82 and retains the inner cutter 88 in such a manner as to allow the reciprocating movement of the inner cutter 88 relative to the outer cutter 82. The chassis 81 has its longitudinal ends slidably received respectively in center vertical slots 93 of the frame 91 and is secured to one of the cassettes 71 to be movable together therewith relative to the frame 91 or the cradle head 30, and is therefore allowed to be depressed or inclined with respect to the width axis of the cradle head 30. When attaching the cutter holder 90 to the cradle head 30 to make the outer cutters 72 in contact with the corresponding inner cutters 78, each outer cutter can be allowed to be independently depressed against a spring force acting on the inner cutter 78 by a spring 43 provided in each of the drive element 42 on the side of the cradle head 30. Further, the inner cutter 78 is swingably connected to the drive element 42 such that each short hair shaving unit 70 can be inclined in opposite directions, in addition to being depressed relative to the cradle head 30 in the like manner as the cradle head does relative to the hand grip. The chassis 81 of the long hair shaving unit 80 is mounted to the frame 91 and is biased upwardly therefrom by longitudinally spaced springs 84. The bias of the springs 84 is additive to the spring bias acting on the inner cutter 78 to give a strong resisting force to the combination of the long hair shaving unit 80 and the outer cutter 72 of the one short hair shaving unit 70 movable together with the long hair shaving unit 80. Thus, the combination is made more resistive to the depressing and inclining movements that the other short hair shaving unit 70, whereby the shaving units 70 can be depressed or inclined independently from each other against different resistances. The biasing forces acting on the shaving units 70 and 80 from the cradle head 30 are made smaller than the biasing force acting on the cradle head 30 from supporting structure 100. With this result, the shaving units 70 and 80 can be displaced without accompanying the relative movement of the cradle head 30 to the hand grip 10 when the shaver is pressed gently against the user's face, and they can be displaced in association with the movement of the cradle head 30 relative to the hand grip 10 when the shaver is pressed rather strongly. Accordingly, the shaving units 70 and 80 can be brought into smooth shaving contact with various face areas as being orientated differently from each other relative to the cradle head 30, and also relative to the hand grip 10, thereby giving a multiplicity of contacting angles to each of the shaving units, as typically shown in FIGS. 10 to 13, for optimum shaving efficiency.

Second Embodiment

Figure 22:
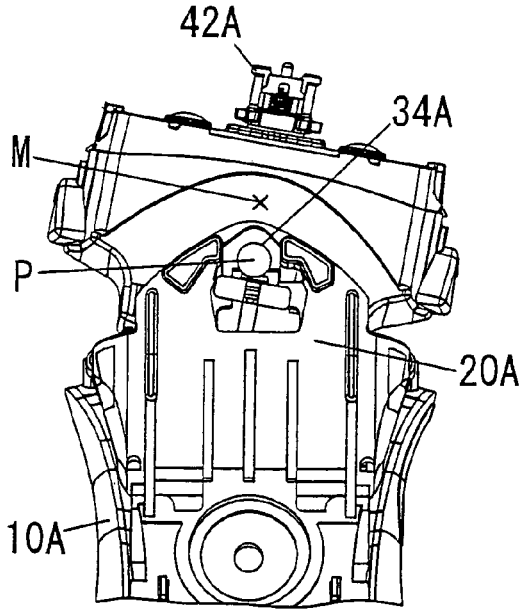
FIGS. 22 and 23 are schematic views showing the tilting movement of a dry shaver about one tilt axis in accordance with a second embodiment of the present invention.
Figure 23:
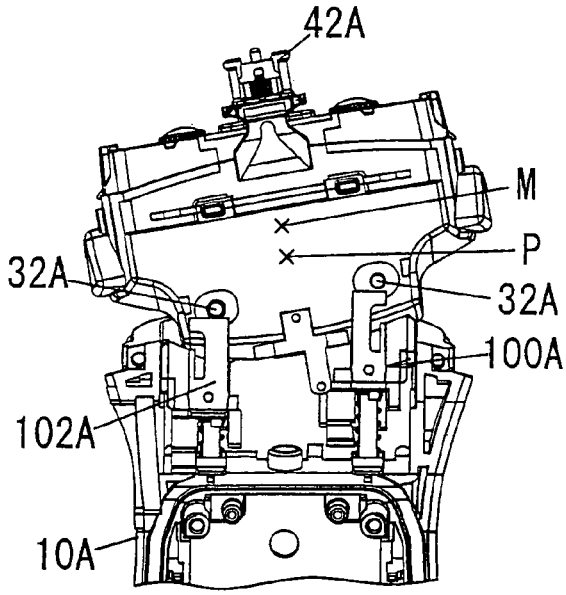

FIGS. 22 and 23

FIGS. 22 and 23 show a dry shaver in accordance with a second embodiment of the present invention which is identical to the first embodiment except that a cradle head 30A is tilted about a single tilt axis relative to a hand grip 10A. Like parts are designated by like reference numerals with a suffix letter of "A". In this embodiment, the cradle head 30A is formed at its width center with a pin 34A. The pin 34A is located below an overall mass center M of the cradle head 30A, and is joined to the upper end of the top guard 20A of the hand grip 10A to define the single tilt axis P below the mass center M. In this connection, the support mechanism 100A is configured such that the levers 102 have their upper ends in slidable contact with the corresponding pins 32A at the lower end of the cradle head 30A to allow the pins 32A to move horizontally relative to the corresponding levers 102A while depressing the levers 102A, thereby assuring the tilting movement of the cradle head 30A about single tilt axis P.

Third Embodiment

FIGS. 24 to 32

Figure 24:
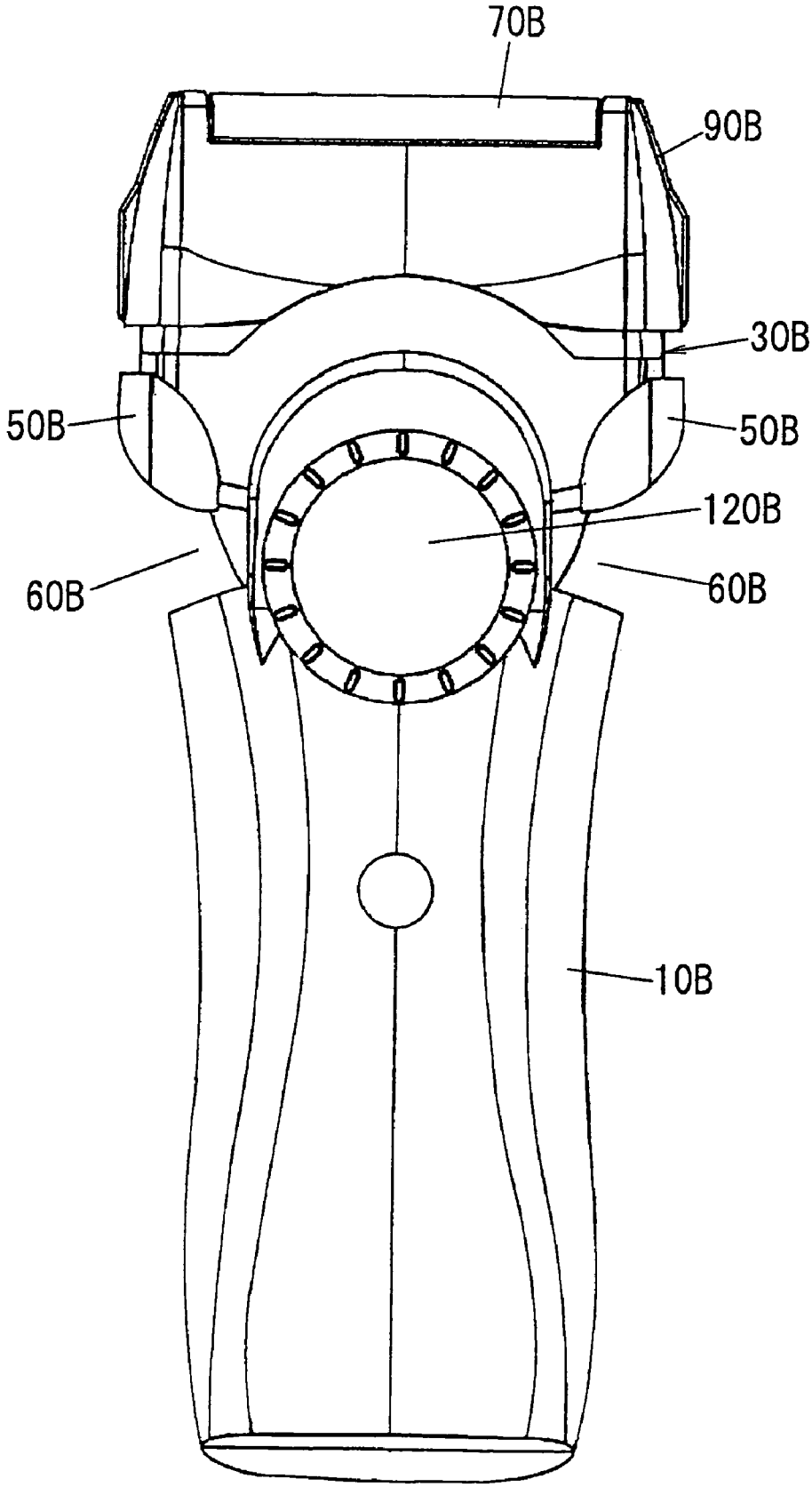
FIG. 24 is a front view of a dry shaver in accordance with a third embodiment of the present invention.
Figure 25:
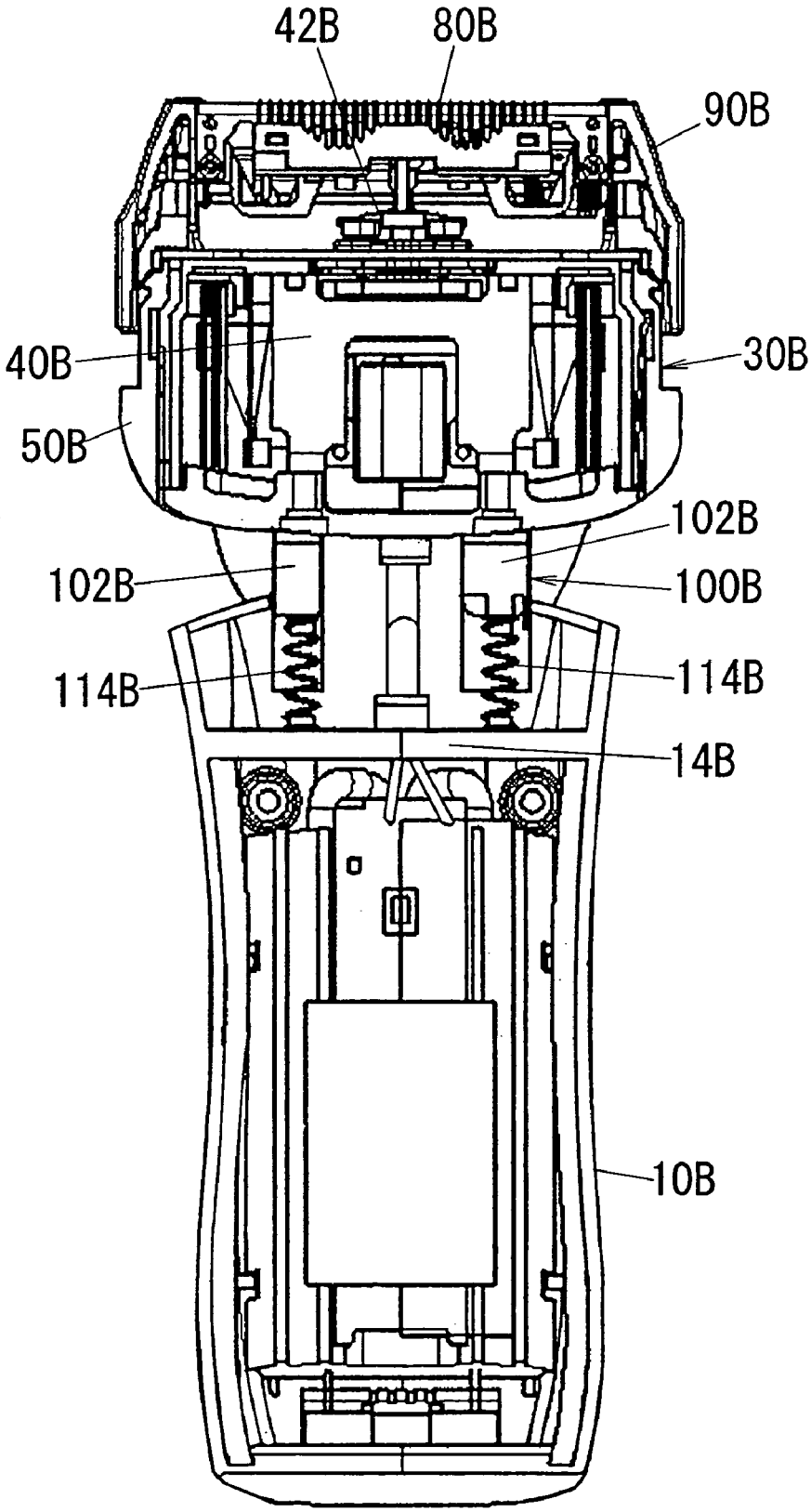
FIGS. 25 and 26 are front sectional views of the above shaver.
Figure 26:
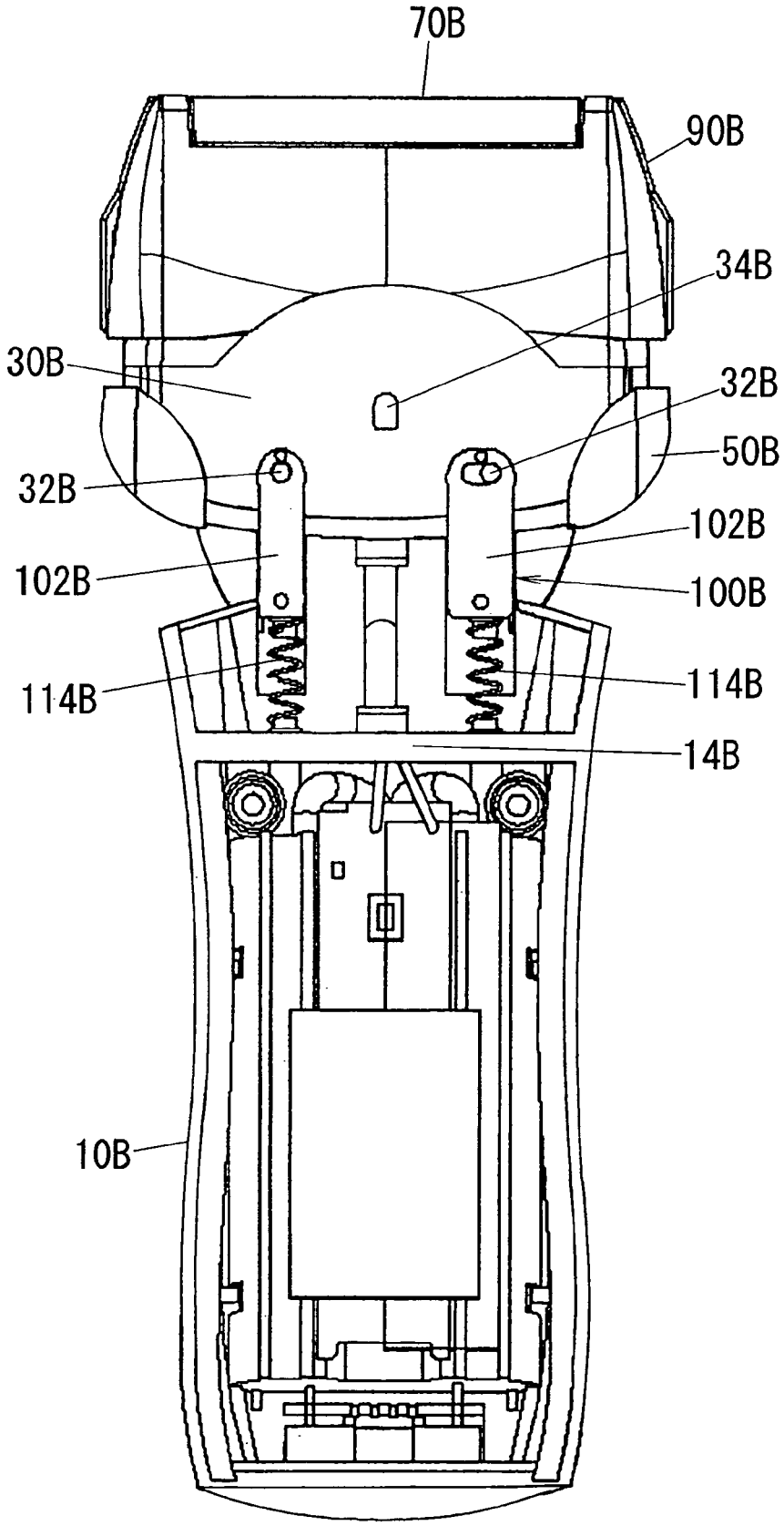

FIG. 24 shows a dry shaver in accordance with a third embodiment of the present invention which is identical to the first embodiment except that an adjustor dial 120B is provided for variably adjusting a spring bias against which a cradle head 30B is depressed or caused to tilt relative to a hand grip 10B. Like parts are designated by like reference numerals with a suffix letter of "B". The cradle head 30B, which carries a plurality of the shaving units 70B and 80B and incorporates the motor 40B in much the same manner as in the first embodiment, is movably supported by a like support mechanism 100B to the hand grip 10B incorporating the batteries 17B and a driving circuitry for the motor 40B.

Figure 27:
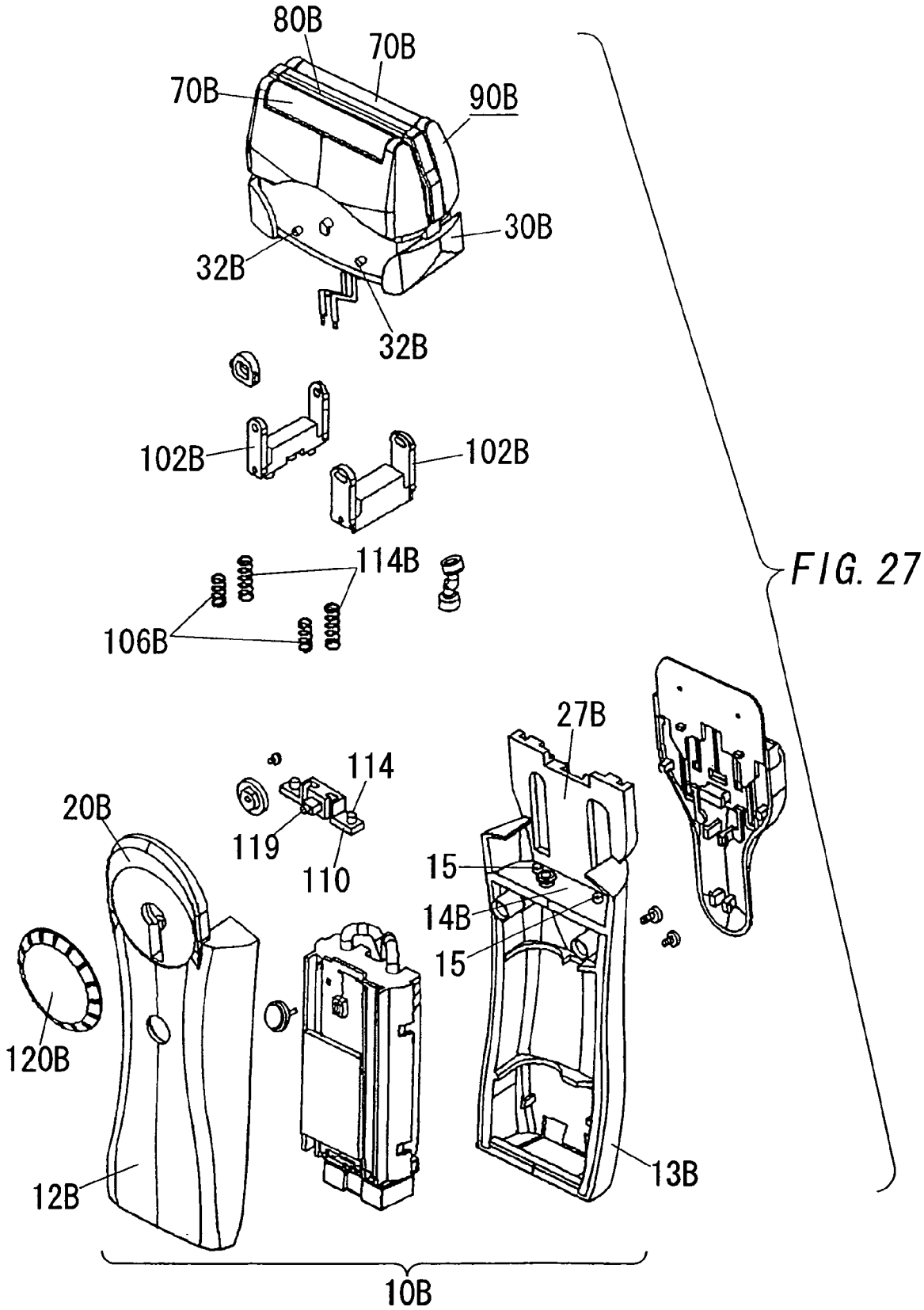
FIGS. 27 and 28 are exploded perspective views of the above shaver.
Figure 28:
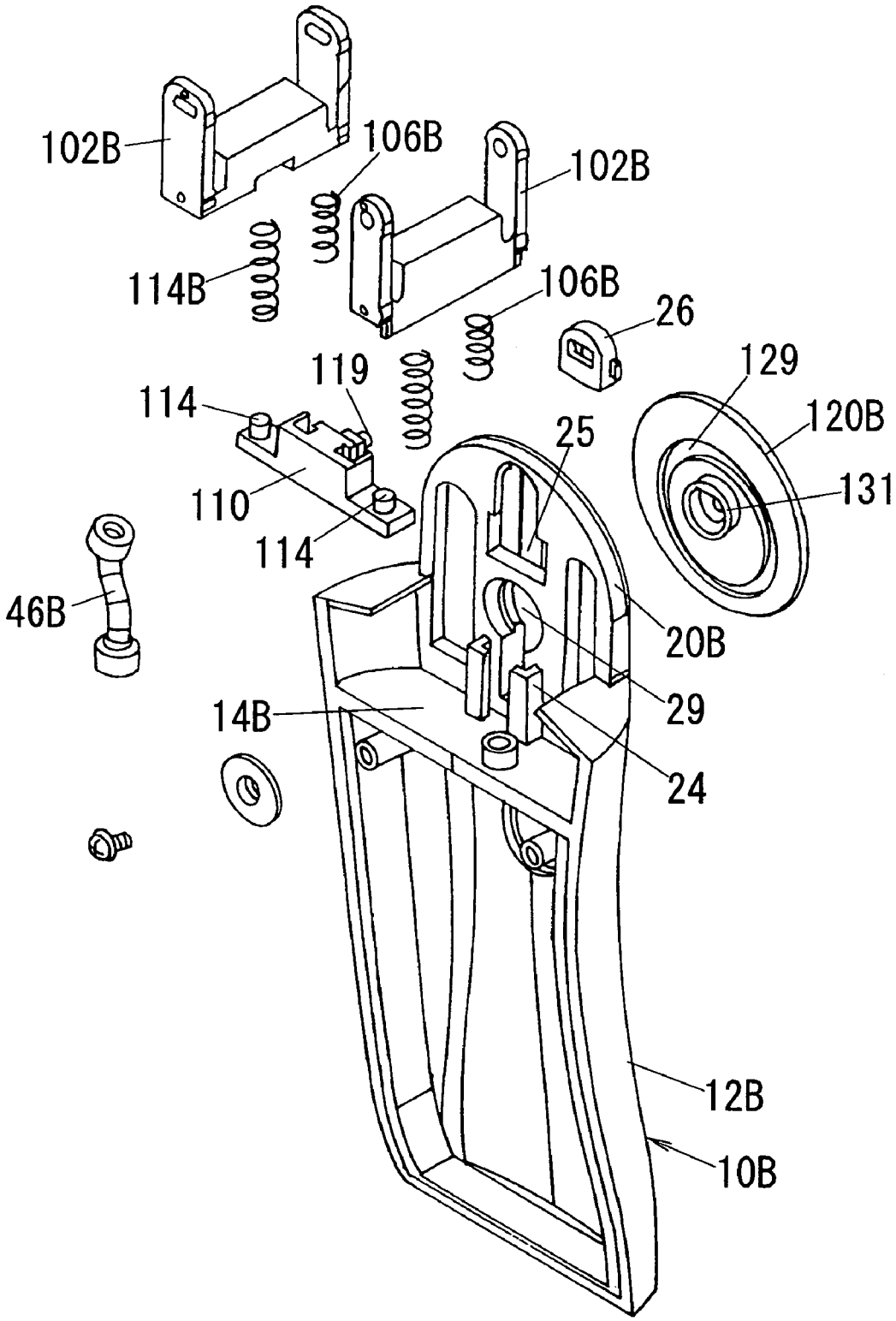
Figure 30:
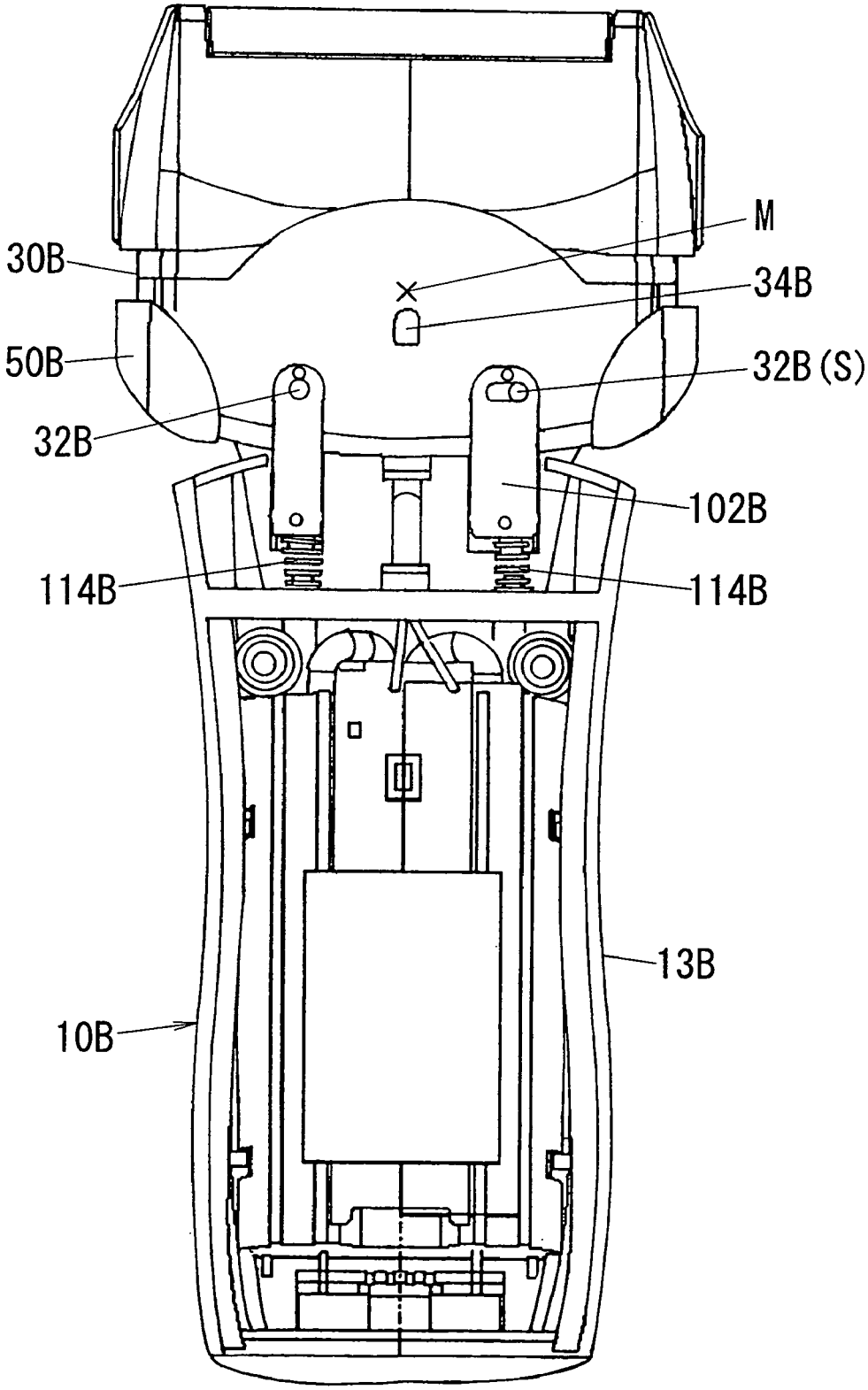
FIGS. 30 to 32 are schematic views illustrating varying positions of the cradle head relative to a hand grip of the above shaver.
Figure 31:
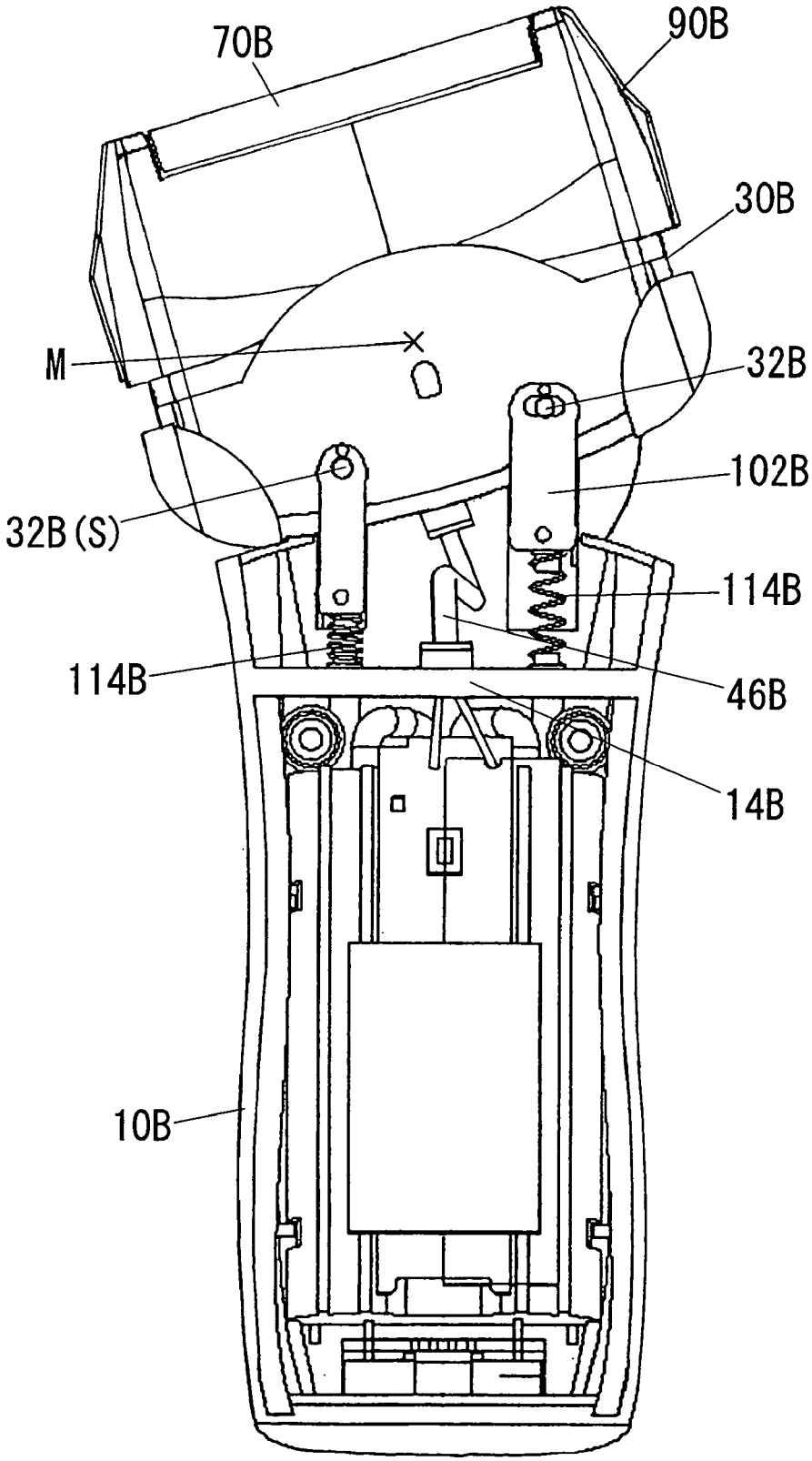
Figure 32:
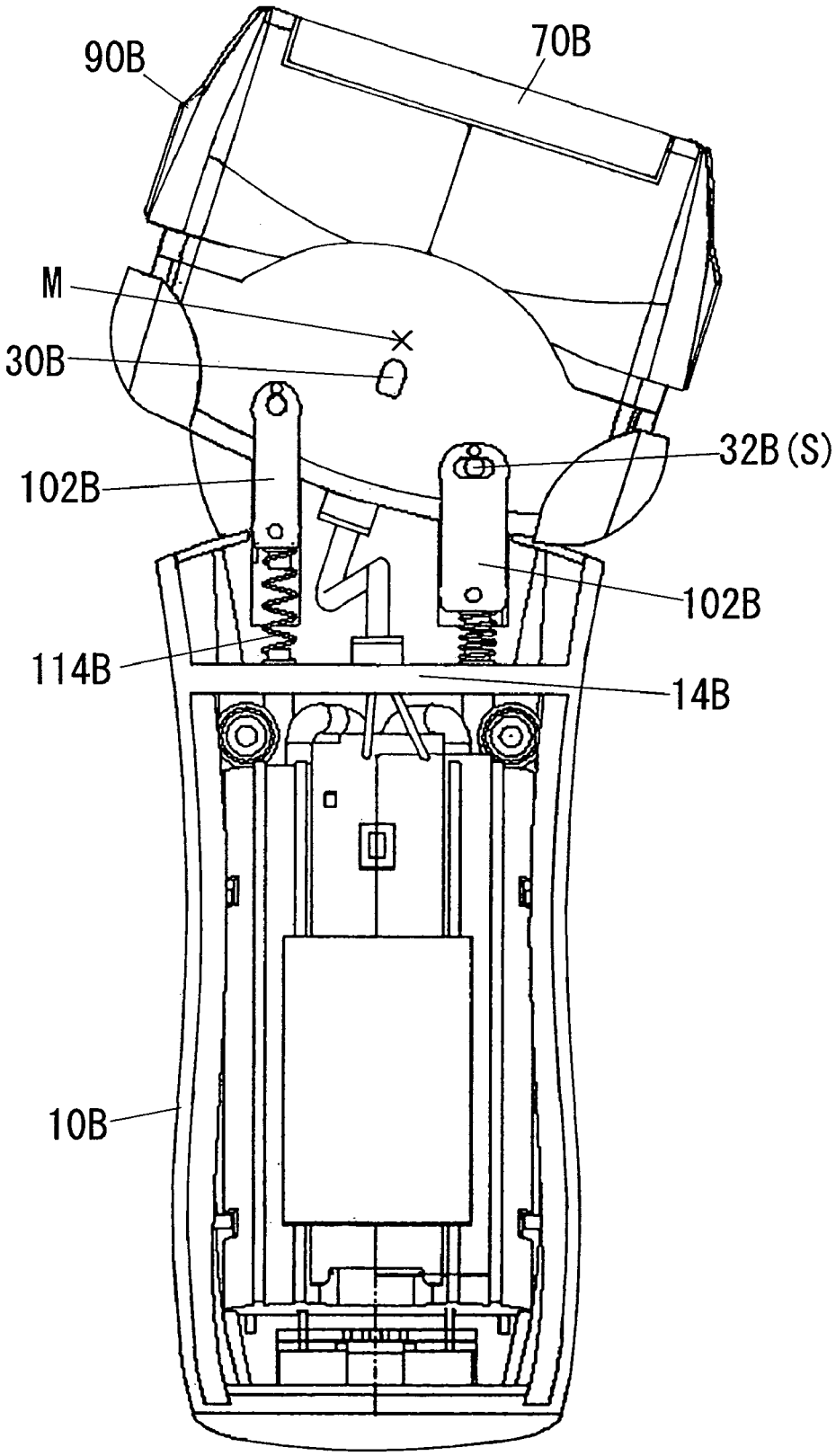

The support mechanism 100B is provided for allowing the cradle head 30B to tilt and/or be depressed relative to the hand grip 10B, and includes a pair of horizontally spaced levers 102B which are pivotally connected respectively at their upper ends to pins 32B projecting at the lower end of the cradle 30B. Each lever 102B has its lower end supported to the upper end of the hand grip 10B by way of two parallel coil springs spaced along a thickness of the hand grip, i.e., a front spring 106B and a rear spring 114B, as best shown in FIGS. 27 and 28. Thus, the cradle head 30B is allowed to be depressed against bias of the springs 106B and 114B as well as to tilt about either of the tilt axes S respectively defined at the pivotal connections of the levers 102B to the cradle head 30B with an associated downward movement of the levers 102B, as shown in FIGS. 30 to 32. The tilt axes S are spaced in the width axis of the cradle head 30B by a distance of less than half of a maximum width of the cradle head. As in the first embodiment, the overall mass center M of the cradle head 30B is located upwardly of the tilt axes P along the height of the hand grip 10B for facilitating the tilting movement of the cradle head 30B.

Turning back to FIGS. 27 and 28, the rear spring 114B of the support mechanism 100B is directly supported to a boss 15 on the top wall 14B of the hand grip, while the front spring 106B is supported to a boss 114 of a floating anchor 110 which is vertically movable relative to the top wall 14B. The anchor 110 is held engaged with guide rails 24 on back of the front top guard 20B to be guided to move vertical, and is engaged with the adjustor dial 120B on front of the front top guard 20B. The adjustor dial 120B is held rotatable with its rear hub 131 engaged into a bearing hole 29 of the front top guard 20B and is connected to the anchor 110 such that the rotational motion of the dial 120B is converted into a vertical linear movement of the anchor 110. Thus, the front springs 106B are compressed to a variable extent by rotating the adjustor dial 120B, enabling to adjust the overall spring force, i.e., the sum of the spring forces acting on the cradle head 30B from the front and rear springs, and therefore giving a suitable bias against which the cradle head is depressed or is caused to tilt. For the above motion conversion, the adjustor ring 120B is formed in its rear surface with an eccentric groove 129 which receives a follower pin 119 projecting on front of the anchor 110.

The cradle head 30B is formed on its front face with a post 34B which engages loosely with a vertical slider 26 fitted in a vertical guide 25 of the front top guard 20B such that the tilting movement of the cradle head 30B is smoothly guided by the vertical movement of the slider 26. The post 34B is engaged with the slider 26 in such a manner as to restrict the cradle head 30B from tilting forwards or rearwards, i.e., about a width axis of the cradle head for smoothly inclining and depressing the cradle head into smooth shaving contact with various areas of the user's face skin.

Figure 29:
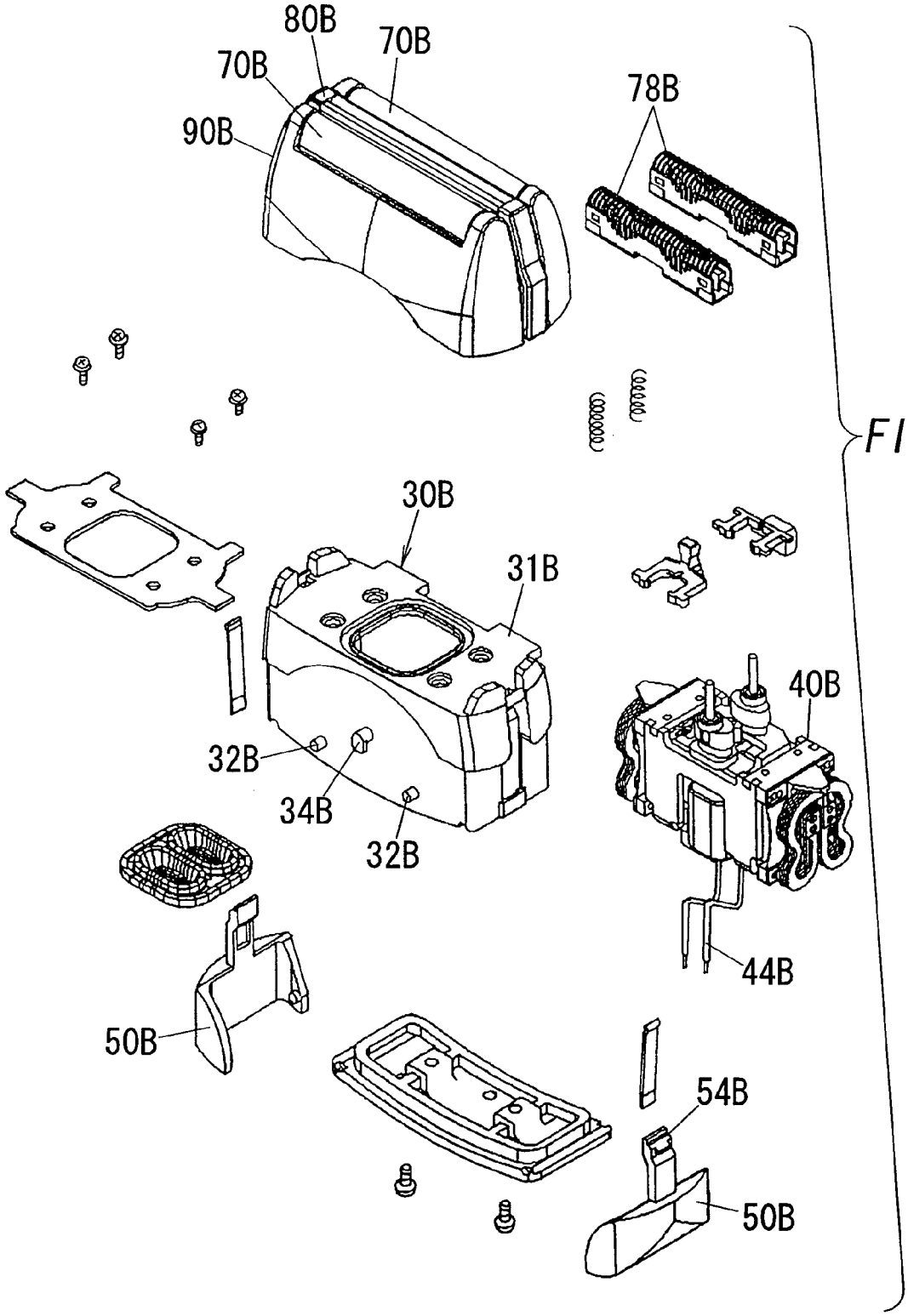
FIG. 29 is an exploded perspective view of a cradle head of the above shaver.

The housing of the hand grip 10B is made up from a front housing half 12B and a rear housing half 13B which are mated together to define the water-tight interior space therebetween for accommodating therein the batteries and the electronic components for the driving circuit. Top plates are formed the upper ends of the halves 12B and 13B are joined to define the top wall 14B closing the upper end of the space. As is formed in the shaver of the first embodiment, gaps 60B are defined respectively between the side extensions of the cradle head and the upper side ends of the hand grip 10B for the same purpose as described with reference to the first embodiment. Also, as shown in FIG. 29, the cradle head 30B has a casing 31B forming a water-tight space in which the motor 40B is received with the driving elements projecting on top of the casing 31B for coupling with the inner cutters of the shaving units 70B and 80B. The motor 40B is connected to the driving circuit in the hand grip 10B by way of a flexible cable 44B surrounded by a sealed sheath 46B. The cradle head 30B also includes a pair of release buttons 50B at the slower side ends for detachment of a cutter holder 90B. The release buttons 50B are pivotally connected at their lower ends respectively to the lower side ends of the cradle head 30B and are formed at their upper ends with hooks 52B for detachable engagement with the cutter holder 90B.

Also in this embodiment, the spring bias, which urges the cradle head 30B to the neutral, i.e., undepressed position relative to the hand grip 10B, is set to be greater than the spring bias urging the shaving units 70B and 80B relative to the cradle head 30B, such that the shaving units are first caused to be displaced independently of the relative movement of the cradle head to the hand grip, and then subsequently caused to be displaced together with the relative movement of the cradle head as the cradle head is pressed at an increasing pressure.

The invention claimed is:

1. A dry shaver comprising:

a hand grip adapted to be grasped by a user's hand, said hand grip having a thickness axis and a height axis, a cradle head mounted on top of said hand grip, said cradle head carrying at least one hair shaving unit composed of an outer cutter and an inner cuter driven to move in hair-shearing engagement with said outer cutter;

a support mechanism which supports said cradle head to said hand grip and allows said cradle head to tilt relative to said hand grip about at least one tilt axis parallel to said thickness axis;

said cradle head carrying a motor for driving said inner cutter and is allowed to tilt together with said motor relative to said hand grip;

wherein said support mechanism allows said cradle head to tilt relative to said hand grip about two tilt axes parallel to said thickness axis, and that said two tilt axes are spaced in a width direction of said hand grip so as to allow said cradle head to tilt about either one of said two tilt axes.

2. The dry shaver as set forth in claim 1, wherein said cradle head is elongated to have a width in the elongated direction, said two tilt axes being spaced along said elongated direction by a distance which is less than a half of said width of the cradle head.

3. The dry shaver as set forth in claim 1, wherein said support mechanism supports said cradle head floatingly to said hand grip so that said cradle head can be depressed with said two tilt axes moving vertically.

4. The dry shaver as set forth in claim 3, wherein said support mechanism includes a spring means which gives a biasing force to urge said cradle head towards an undepressed position where the cradle head has its width axis kept substantially perpendicular to the height axis of said hand grip.

5. The dry shaver as set forth in claim 4, wherein said support mechanism includes an adjustor which acts on said spring means to vary said bias force.

6. The dry shaver as set forth in claim 5, wherein said adjustor includes a lock means for locking said cradle head to said undepressed position.

7. The dry shaver as set forth in claim 1, wherein said support mechanism includes a lock means for locking the movement of said cradle head relative to said hand grip.

8. The dry shaver as set forth in claim 1, wherein said cradle head includes a casing being formed separately from said hand grip and accommodating therein said motor, said casing being coupled to said hand grip as such a position that said cradle head has its overall mass center upwardly of said tilt axis along the height axis of said hand grip.

9. The dry shaver as set forth in claim 8, wherein said hand grip has an interior space which accommodates therein a battery for energizing the motor, and has a top wall closing the upper end of said interior space, said cradle head has its lower end entirely spaced upwardly of the said top wall of the hand grip.

10. The dry shaver as set forth in claim 8, wherein said motor is electrically connected by a flexible cable to a driving circuit accommodated in said hand grip together with a battery for energizing said motor.

11. The dry shaver as set forth in claim 10, wherein said cradle head as well as said hand grip are made watertight with sealing sheath fitted around said cable over the entire length thereof inclusive of the connections respectively with said cradle head and said hand grip.

12. The dry shaver as set forth in claim 11, wherein said support mechanism is arranged outside of water-tight spaces of said cradle head and said hand grip.

13. The dry shaver as set forth in claim 1, wherein said hand grip has a top guard projecting on top of said hand grip to overlap a lower end of said cradle head in order to protect said cradle head from moving in directions not associated with tilt movement of said cradle head as well as depressing movement of said cradle head.

14. The dry shaver as set forth in claim 13, wherein said top guard is provided with a guide which comes into slidable engagement with a portion of said cradle head for guiding the tilt and floating movement thereof.

15. The dry shaver as set forth in claim 1, wherein said cradle head is elongated in its width direction and is formed on opposite width ends respectively with side extensions, each said side extension being cooperative with a corresponding upper width end of said hand grip to define therebetween a gap which is opened at an outer width end and closed at an inner width end, said gap being greater towards said outer width end than at said inner width end for accommodating the tilt movement of said cradle head.

16. The dry shaver as set forth in claim 15, wherein said side extensions are formed respectively with release buttons for detaching said outer cutter from said cradle head when pressed.

17. The dry shaver as set forth in claim 16, wherein each of said release buttons has its lower end pivotably connected to the lower end of said side extension to pivot about a pivot axis extending in the thickness axis of said hand grip, said release button being formed at its upper end with a hook for detachable engagement with said outer cutter.

18. The dry shaver as set forth in claim 1, wherein said support mechanism includes spring means for biasing said cradle head towards a neutral position from which it is allowed to tilt about said at least one tilt axis upon receiving an external force caused by contact with a user's skin, said cradle head carrying a plurality of said shaving units each being elongated to have a width axis extending generally in parallel with a widthwise axis of said cradle head, at least one of said shaving units being floatingly supported at the opposite width ends thereof to said cradle head such that said at least one shaving unit is capable of being inclined against a spring bias with its width axis angled with respect to said widthwise axis of the cradle head as well as of being vertically depressed against said spring bias with its width axis kept in parallel with said widthwise axis, said spring bias of urging said at least one shaving unit relative to said cradle head being lower than that of urging said cradle head relative to said hand grip.

19. The dry shaver as set forth in claim 18, wherein all of said shaving units are movably supported to said cradle head to be capable of being inclined and depressed independently from each other relative to said cradle head.

* * * * *